US007346285B2

(12) United States Patent
Nagahama et al.

(10) Patent No.: US 7,346,285 B2
(45) Date of Patent: Mar. 18, 2008

(54) IMAGE FORMING APPARATUS, CONTENT MEASUREMENT METHOD, AND METHOD OF CONTROLLING ROTATION OF ROTATING MEMBER IN IMAGE FORMING APPARATUS

(75) Inventors: Hitoshi Nagahama, Uji (JP); Kazuya Koyama, Ikoma (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 324 days.

(21) Appl. No.: 11/196,760

(22) Filed: Aug. 4, 2005

(65) Prior Publication Data

US 2006/0029406 A1 Feb. 9, 2006

(30) Foreign Application Priority Data

Aug. 9, 2004 (JP) ..... 2004-232575
Aug. 9, 2004 (JP) ..... 2004-232614

(51) Int. Cl.
*G03G 15/00* (2006.01)
*G03G 15/08* (2006.01)

(52) U.S. Cl. ..... 399/8; 399/9; 399/27

(58) Field of Classification Search ..... 399/8, 399/9, 12, 13, 24, 27
See application file for complete search history.

(56) References Cited

U.S. PATENT DOCUMENTS 5,907,756 A 5/1999 Shirota et al.
6,351,621 B1 * 2/2002 Richards et al. ..... 399/12
6,385,407 B1 5/2002 Inose ..... 399/24
6,694,106 B2 * 2/2004 Yoshimura ..... 399/12
6,892,033 B2 5/2005 Sunada et al. ..... 399/13
7,095,964 B2 * 8/2006 Koyama et al. ..... 399/24

FOREIGN PATENT DOCUMENTS

| | | |
|---|---|---|
| JP | 10-48935 | 2/1998 |
| JP | 10-221938 A | 8/1998 |
| JP | 10-319704 A | 12/1998 |
| JP | 11-142220 | 5/1999 |
| JP | 2000-177213 A | 6/2000 |
| JP | 2000-246921 A | 9/2000 |
| JP | 2001-22230 A | 1/2001 |
| JP | 2001-117309 A | 4/2001 |
| JP | 2002-99137 A | 4/2002 |
| JP | 2003-98789 A | 4/2003 |
| JP | 2003-271021 A | 9/2003 |
| JP | 2004-114652 A | 4/2004 |
| JP | 2004-224470 A | 8/2004 |

* cited by examiner

*Primary Examiner*—William J. Royer
(74) *Attorney, Agent, or Firm*—Nixon & Vanderhye, P.C.

(57) ABSTRACT

An image forming apparatus includes a communication section that wirelessly communicates with an RFID tag on a toner supply container. Based on a state of communication between the RFID tag and the communication section, an amount of toner in the toner supply container is measured, or a rotational angle of the toner supply container is detected. Since it is unnecessary to additionally provide a member for measuring the amount of the toner or detecting the rotational angle, the number of components can be reduced.

48 Claims, 13 Drawing Sheets

IMAGE FORMING APPARATUS, CONTENT MEASUREMENT METHOD, AND METHOD OF CONTROLLING ROTATION OF ROTATING MEMBER IN IMAGE FORMING APPARATUS

This Nonprovisional application claims priority under 35 U.S.C. § 119(a) on patent application Ser. No. 2004-232575 filed in Japan on Aug. 9, 2004 and patent application No. 2004-232614 filed in Japan on Aug. 9, 2004, the entire contents of which are hereby incorporated by reference.

FIELD OF THE INVENTION

The present invention relates to an image forming apparatus that wirelessly exchanges information with a content storage member storing predetermined goods and also to a content measurement method.

The present invention also relates to an image forming apparatus that wirelessly communicates with a rotating member, and a method of controlling the rotation of the rotating member.

BACKGROUND

In electrophotographic image forming apparatuses such as printers, photocopiers, and facsimiles, members thereof have different service lives. In this respect, an image forming apparatus is arranged in such a way that members, which are, for instance, of short service life on account of frequent use and are used for supplying consumption articles such as developer, are attached to the main body of the image forming apparatus in a detachable manner, and those attached members are replaced as need arises.

In regard to the replacement of the attached member, to prevent the attached member from being erroneously attached and to properly carry out maintenance in accordance with maintenance information such as service lives, record of replacements, and manufacturing information of attached members, there are technologies (e.g. Japanese Laid-Open Patent Application No. 2001-22230 (published on Jan. 26, 2001), Japanese Laid-Open Patent Application No. 10-221938/1998 (published on Aug. 21, 1998), and Japanese Laid-Open Patent Application No. 2001-117309 (published on Apr. 27, 2001)) that allow an attached member and the main body of the image forming apparatus to communicate wirelessly with each other, on the occasion of replacing the attached member.

More specifically, a communication device is provided on the main body side, while the attached member is provided with a communication element including an IC memory storing the maintenance information and the like and an antenna for non-contact communication with the communication device. With this arrangement, the image forming apparatus and the attached member exchange information. The user is therefore warned, by means of a displayed message or the like, that the attached member is erroneously attached or the attached member approaches the end of the service life. In this manner, maintenance information is exchanged between the attached member and the main body of the image forming apparatus, so that the maintenance ability or the like of the image forming apparatus is improved by efficiently and easily managing the attached member.

A developing cartridge, a developer container and the like, which are used for supplying developer consumed in image formation, are known as typical attached members to which the communication element is attachable.

For example, Japanese Laid-Open Patent Application No. 10-319704/1998 (published on Dec. 4, 1998) discloses a developing apparatus that estimates an amount of developer, using a stirring bar for stirring the developer and a sensor for detecting in what manner the stirring bar moves, which are provided in a developer container. In the developing apparatus of the aforesaid publication, a stirring bar that is foldable at a position between an arm base portion and an arm tip portion rotates, and an amount of developer is estimated by detecting to what degree the rotating stirring bar is folded.

However, while information exchange using a communication element has conventionally been carried out for the maintenance of an image forming apparatus (e.g. management of an attached member), the following has not been known (First Problem): the content is measured by checking a state of communication (information transmission) between a communication. element of the attached member and a communication section in the main body of the image forming apparatus.

There is a known technology by which, in order to supply a developer to a developing apparatus in an image forming apparatus, the developer is supplied by rotating a cylindrical developer container. In a case where such a developer container is adopted, the rotation of the developer container causes the developer to be transported to a supply opening through which the developer is discharged.

As in the case of the aforesaid developer container, an attached member (hereinafter, rotating member) rotating in the image forming apparatus may be required to stop the rotation at a predetermined position or may have its rotational angle controlled in line with the function and use thereof.

For instance, the developer container rotates in order to transport, to the supply opening, the developer stored therein. On this account, it is sometimes required to control a position at which the rotation of the developer container stops. This arrangement is required for preventing the developer from being coagulated in the developer container and preventing the developer from being clogged in the supply opening of the developer container.

The developer container is provided for supplying a developer to an image forming apparatus, and is replaced (detachable) once the developer runs out. On this account, in order to prevent the developer from flowing out through the supply opening of the developer container when the developer container is detached from the image forming apparatus, it is sometimes required to control the rotational angle of the developer container in such a way that the supply opening locates at a predetermined position.

However, while information exchange using a communication element has conventionally been carried out for the maintenance of an image forming apparatus (e.g. management of an attached member), the following has not been known (Second Problem): the operation of an attached member is controlled by checking a state of communication (information transmission) between a communication element of the attached member and a communication section in the main body of the image forming apparatus.

BRIEF SUMMARY

The present technology solves the first problem of the conventional technology. The objective (first objective) is therefore to provide an image forming apparatus and a content measurement method, by which the content of a content storage member can be measured by performing wireless-communication with the content storage member storing predetermined content.

To achieve the above-described objective, the image forming apparatus: a communication section that communicates, in a non-contact manner, with a communication element attached to a content storage member storing predetermined content; and a content measurement section that measures the content of the content storage member, based on a change in a state of communication between the communication section and the communication element, the change occurring on account of the content existing between the communication section and the communication element.

According to this arrangement, the content of the content storage member is measured based on a change in a state of communication between the communication section and the communication element, the change occurring on account of the content existing between the communication section and the communication element.

On this account, not only the information transmission but also the measurement of the content are achieved using the communication element and the communication section, so that the image forming apparatus can be structurally simplified. Also, since the number of components is reduced on account of the above, it is possible to lower the cost of the image forming apparatus.

To achieve the above-described objective, a content measurement method, for an image forming apparatus including: a content storage member that stores predetermined content and has a communication element; and a communication section that communicates, in a non-contact manner, with the communication element, is arranged in such a manner that, the content of the content storage member is measured based on a state of communication between the communication element and the communication section.

According to this method, the content of the content storage member can be measured using the communication element and the communication section performing information transmission therebetween. In this manner, the method allows for both the information transmission and the measurement of the content of the content storage member, using the communication element and the communication section, thereby resulting in simplification of the image forming apparatus in terms of structure, and reduction of costs.

The present technology solves the second problem of the conventional technology. The objective (second objective) is therefore to provide an image forming apparatus capable of controlling a rotating member and a method of controlling the rotation of the rotating member, by performing wireless-communication with the rotating member that rotates in the main body of the image forming apparatus.

To achieve this objective, the image forming apparatus of an example embodiment comprises: a communication section that communicates, in a non-contact manner, with a communication element provided on a rotating member rotatable inside a main body of the image forming apparatus, the communication element on the rotating member being away in a radial direction from a rotation axis of the rotating member; a rotational angle detection section that detects a rotational angle of the rotating member, based on a change in a state of communication between the communication section and the communication element, the change occurring on account of a variation, in response to rotation of the rotating member, in relative positions of the communication element and the communication section; and a rotation control section that controls the rotation of the rotating member, in accordance with the rotational angle detected by the rotational angle detection section.

According to this arrangement, the rotational angle detection section detects the rotational angle of the rotating member, based on a change in a state of communication between the communication section and the communication element, the change occurring on account of a variation, in response to the rotation of the rotating member, in relative positions of the communication element and the communication section. Also, the rotation control section controls the rotation of the rotating member, in accordance with the rotational angle detected by the rotational angle detection section.

On this account, not only the information transmission but also the detection of the rotational angle of the rotating member are achieved using the communication element and the communication section, so that the image forming apparatus can be structurally simplified. Also, since the number of components is reduced on account of the above, it is possible to lower the cost of the image forming apparatus.

To achieve the above-described objective, a method of controlling rotation, for an image forming apparatus including: a rotating member that is rotatable in the image forming apparatus and has a communication element, and a communication section that communicates, in a non-contact manner, with the communication element, is characterized in that, rotation of the rotating member is controlled based on a state of communication between the communication element and the communication section.

According to the method, the rotational angle of the rotating member can be controlled using the communication element and the communication section provided for information transmission. Therefore, according to the method both the control of the information transmission and the control of the rotation of the rotating member can be conducted using the communication element and the communication section. On this account, it is possible to structurally simplify the image forming apparatus, and lower the cost of the image forming apparatus.

For a fuller understanding of the nature and advantages of the invention, reference should be made to the ensuing detailed description taken in conjunction with the accompanying drawings.

BRIEF DESCRIPTION OF THE DRAWINGS

FIG. 1(*b*) is a cross section of a third container section of the toner supply container.

FIG. 4(*b*) is a cross section of the RFID tag. FIG. 4(*c*) illustrates the directivity in communication by the RFID tag.

FIG. 11(*b*) is a cross section of a scraper in a first recessed portion of the third container section.

DESCRIPTION OF THE EMBODIMENTS

An example embodiment will be described with reference to FIGS. 1(*a*)-13.

An image forming apparatus of the present embodiment is, for instance, an electrophotographic printer, an electrophotographic photocopier, or an electrophotographic facsimile, or a digital multifunction apparatus functioning as those apparatuses. The image forming apparatus of the present embodiment operates so as to wirelessly communicate with a content storage member storing content whose amount varies in accordance with the operation of the image forming apparatus, so that the content of the content storage member is measured. Also, the image forming apparatus of the present embodiment wirelessly communicates with a rotating member rotating in the main body of the image forming apparatus, so that a rotational angle of the rotating member is detected.

Any type of member may be adopted as the content storage member on condition that content can be stored therein. Also, as the rotating member, any type of member may be adopted on condition that the member is rotatable in the image forming apparatus.

In the following description, a toner supply container (content storage member, rotating member, developer supply container) storing therein toner (content, developer) for the image forming apparatus exemplifies the content storage member and the rotating member.

Figure 1:
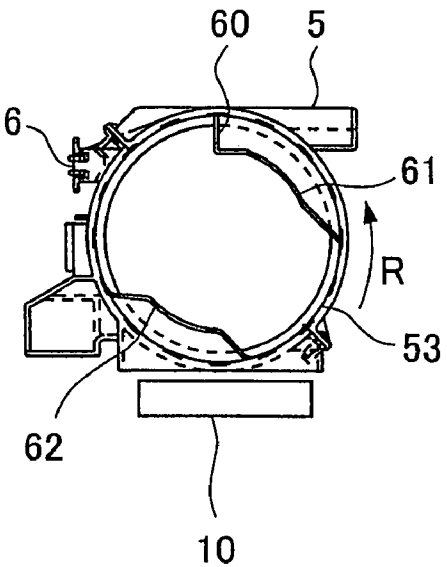
FIG. 1(*a*) is a side view of an embodiment of a toner supply container in an image forming apparatus of an example embodiment.
Figure 1:
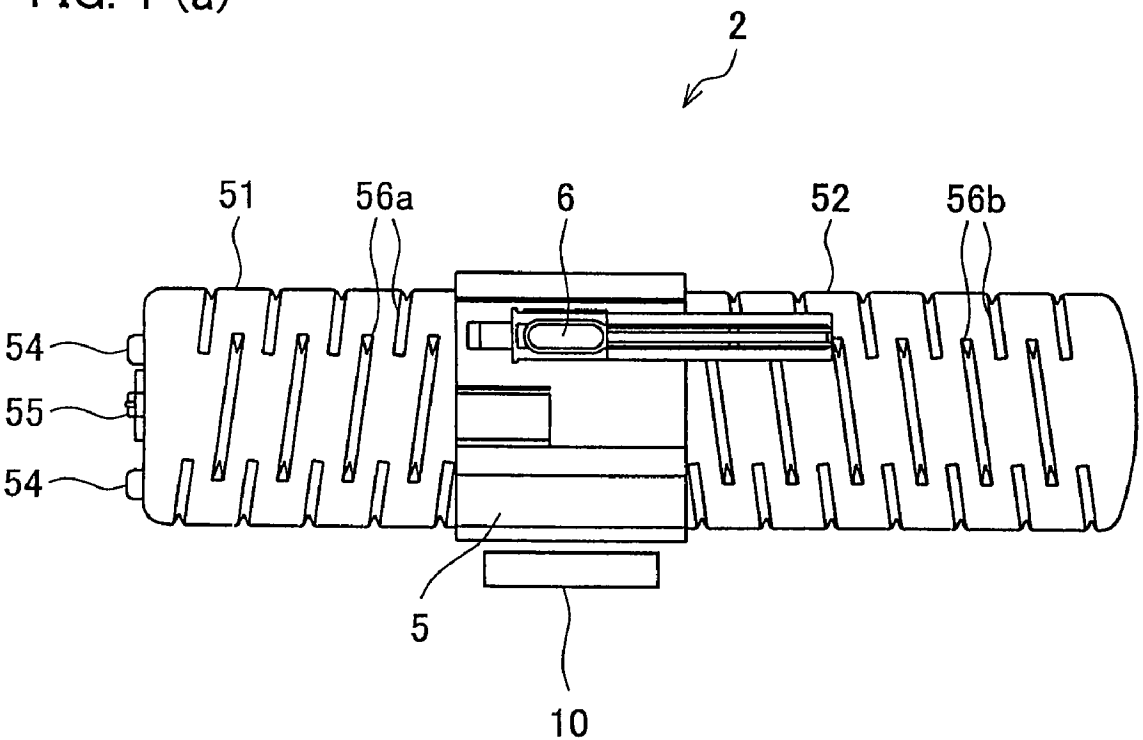
Figure 2:
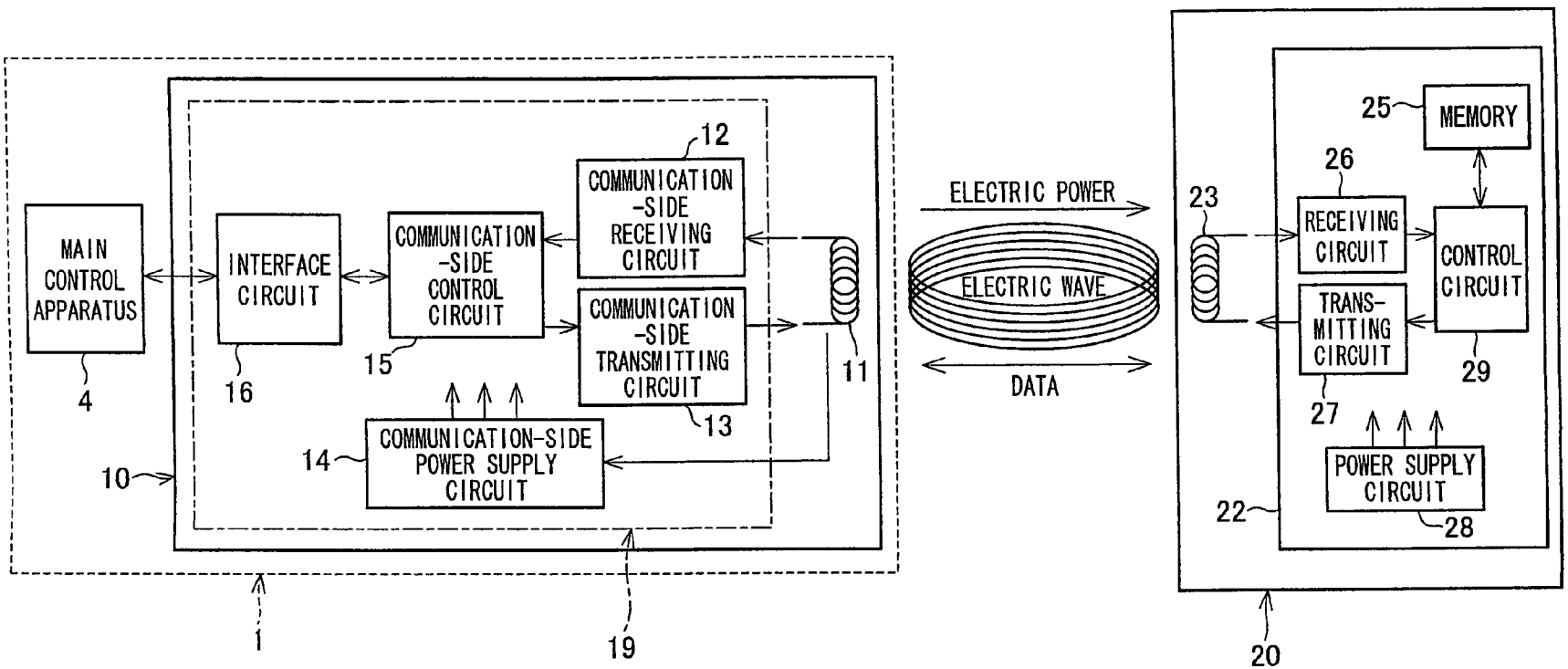
FIG. 2 is a block diagram for illustrating communication between a communication section in the image forming apparatus and an RFID tag attached to the toner supply container.
Figure 3:
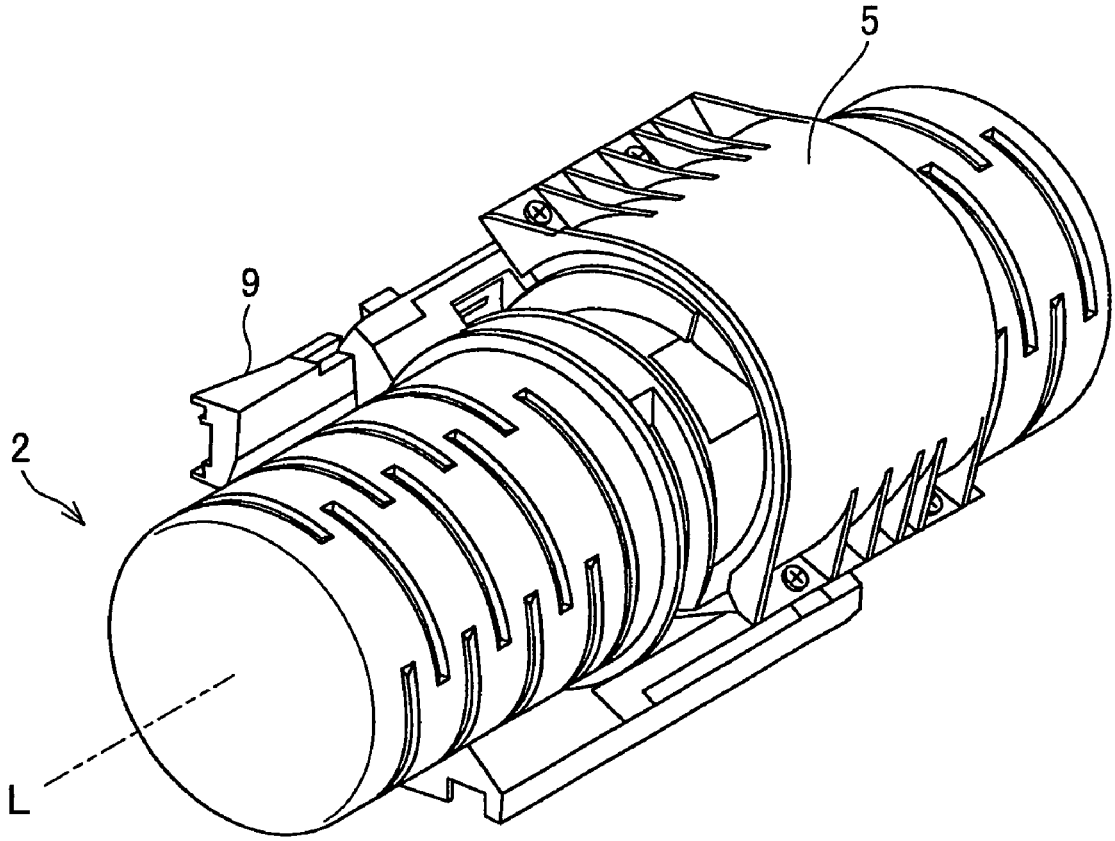
FIG. 3 is an oblique perspective view of the toner supply container.

FIG. 2 is a block diagram for illustrating the communication between the main body of the image forming apparatus 1 and the toner supply container 2. FIGS. 3, 1(*a*) and 1(*b*) are an oblique perspective view, a side view, and a cross section of the toner supply container 2, respectively.

As shown in FIG. 1(*a*), the image forming apparatus 1 includes: as a content storage member and a rotating member, a toner supply container 2 having a peripheral surface on which an RFID tag (communication element 20 (FIG. 2)) is attached; a communication section 10 that communicates with the RFID tag 20 in a non-contact manner; and a main control apparatus (content measurement section, rotational angle detection section, communication control section, rotation control section) 4 (FIG. 2) such as a CPU, which controls the operations of the sections of the image forming apparatus 1. As shown in FIG. 1(*a*), the communication section 10 is provided at a position of facing, in a non-contact manner, the outer peripheral surface of the toner supply container 2. It is noted that, since the RFID tag 20 is an example of a communication device, the communication device may be an IC tag or the like.

More specifically, as shown in FIGS. 1(*a*) and 1(*b*), the communication section 10 locates directly below the toner supply container 2 and faces the peripheral surface of the toner supply container 2, when the toner supply container 2 is attached to the image forming apparatus 1. In this state, a position of the RFID tag 20 inside the image forming apparatus 1 changes in line with the rotation of the toner supply container 2. While the toner supply container 2 rotates for 360°, the RFID tag 20 faces the communication section 10 at least once.

Figure 4:
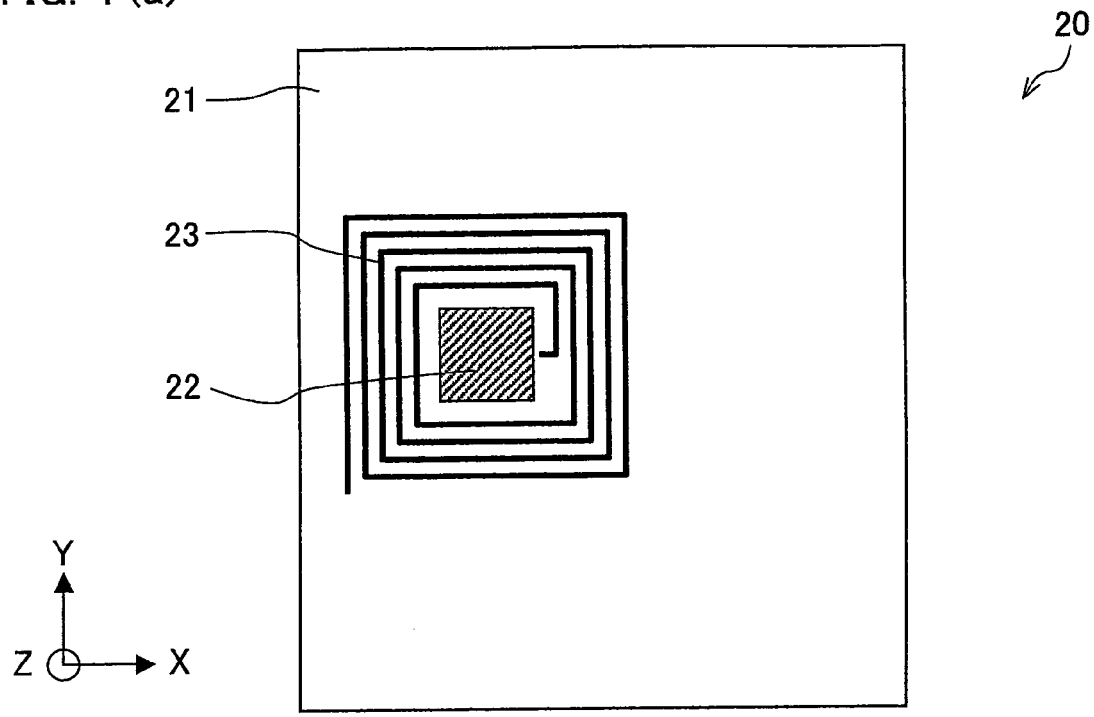
FIG. 4(*a*) is a plan view of the RFID tag.
Figure 4:
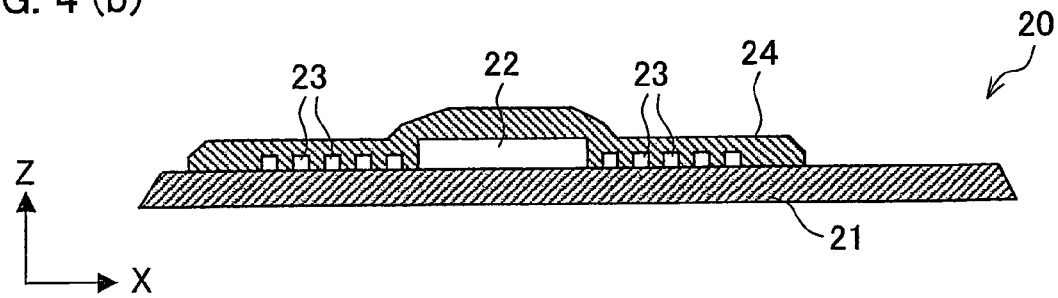
Figure 4:
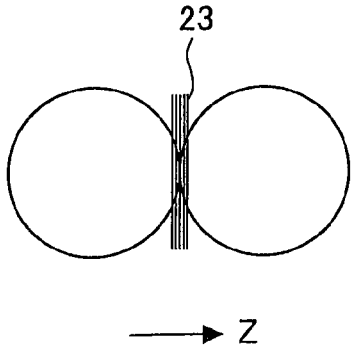

FIGS. 4(*a*) and 4(*b*) are a plan view and a cross section of the RFID tag 20, respectively. FIG. 4(*c*) illustrates the directivity in the communication by the RFID tag 20.

As shown in FIG. 4(*b*), the RFID tag 20 includes an IC chip 22 and an antenna section 23 that are electrically connected to each other. As shown in FIGS. 4(*a*) and 4(*b*), the antenna section 23 is arranged in such a manner that, the IC chip 22 including below-mentioned circuits is provided on a base film 21, and on the base film 21, the IC chip 22 is surrounded for several times by a wire such as a metal thin film. Also, as shown in FIG. 4(*b*), the IC chip 22 and the antenna section 23 are covered with a protective film 24.

The antenna section 23 sends and receives an electromagnetic wave (communication wave) for information transmission with the communication section 10. The antenna section 23 may be made up of two antennas for sending and receiving, respectively, or may be capable of performing both sending and receiving. As shown in FIG. 4(*c*), the directivity in two-way communication by the antenna section 23 is in the direction of facing the antenna section 23 (i.e. an area indicated by circles in the Z direction in the figure).

Meanwhile, as shown in FIG. 2, the communication section 10 of the image forming apparatus 1 includes a communication-side antenna section (communication device) 11 and an IC section 19 including below-mentioned circuits. The communication-side antenna section 11 is provided for wirelessly reading information from the RFID tag 20 of the toner supply container 2 or writing information into the RFID tag 20. This allows for information transmission. Although not illustrated in the figures, this communication-side antenna section 11 also has the directivity in two-way communication, as in the case of the antenna section 23.

In this manner, each of the RFID tag 20 and the communication section 10 has the directivity in communication. The information transmission between the RFID tag 20 and the communication section 10 is optimized when the directivity of the antenna section 23 of the RFID tag 20 is matched with or in parallel to the directivity of the communication-side antenna section 11. By the way, in the present specification, the terms "matched" and "in parallel" include states of "substantially matched" and "substantially in parallel", respectively.

Therefore, to realize suitable information transmission between the RFID tag 20 and the communication section 10, it is preferable that the communication-side antenna section 11 of the communication section 10 and the antenna section 23 of the RFID tag 20 be disposed in such a manner as to keep the directivity of the antenna section 23 to be matched with or in parallel to the directivity of the communication-side antenna section 11, at least once in 360° rotation of the toner supply container 2 in the R direction in FIG. 1(*b*).

As described above, the RFID tag 20 and the communication section 10 have directivities in communication. On this account, a state of communication between the RFID tag 20 and the communication section 10 varies in accordance with relative positions of the antenna section 23 of the RFID tag 20 and the communication-side antenna section 11 of the communication section 10. Moreover, since the communication between the RFID tag 20 and the communication section 10 is performed through an electromagnetic wave, the state of the communication also varies in accordance with (i) a relative distance between the antenna section 23 and the communication-side antenna section 11, and (ii) influences of intermediates between the antenna section 23 and the communication-side antenna section 11, e.g. a dielectric layer, a semiconductor layer, and magnetic layer.

As described above, in the image forming apparatus 1 of the present embodiment, the RFID tag 20 is provided in the toner supply container 2, and the communication-side antenna section 11 is fixed at a predetermined position of the image forming apparatus 1. On this account, as the toner supply container 2 rotates, relative positions of the communication-side antenna section 11 and the antenna section 23 change. In line with this change in the relative positions, a state of communication between the RFID tag 20 and the antenna section 23 also changes.

Figure 5:
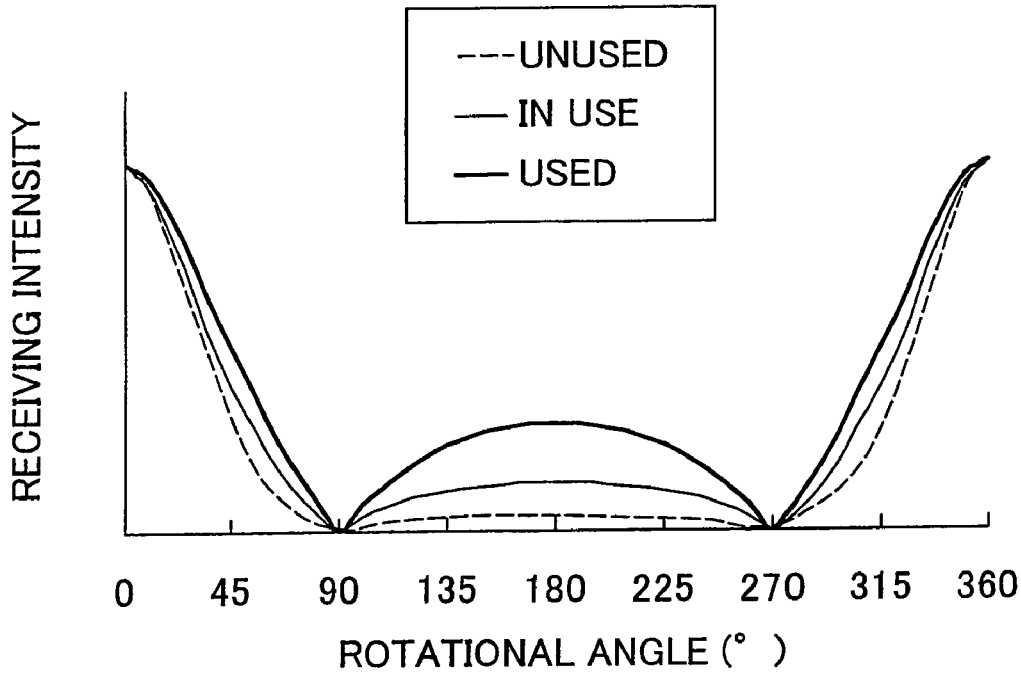
FIG. 5 is a graph indicating the relationship between a rotational angle of the toner supply container and receiving intensity.

A state of communication between the RFID tag 20 and the communication section 10 changes in accordance with the rotation of the toner supply container 2, for instance, as shown in FIG. 5. FIG. 5 is a graph in which plotted are receiving intensities of an output (communication wave) supplied from the RFID tag 20 to the communication section 10.

A state of communication between the RFID tag 20 and the communication section 10 is optimized when (i) the directivity of the antenna section 23 of the RFID tag 20 is matched with or in parallel to the directivity of the communication-side antenna section 11 of the communication section 10, and (ii) the distance between the antenna section 23 and the communication-side antenna section 11 facing one another is the closest. On this account, it is assumed that, in the image forming apparatus 1 of the present embodiment, the RFID tag 20 and the communication section 10 face one another when the receiving intensity is maximum. In this state, it is also assumed that the directivities of the antenna section 23 and the communication-side antenna section 11 are matched with each other or in parallel to each other, and the distance between the antenna section 23 and the communication-side antenna section 11 are the closest. In FIG. 5, a rotational angle of the toner supply container 2 is set at 0° when the receiving intensity is maximum.

As the rotational angle of the toner supply container 2 changes from the aforesaid 0° to 90° or 270°, the receiving intensity is minimized. In this state, the RFID tag 20 of the toner supply container 2 does not face the communication section 10, and the directivity of the antenna section 23 is orthogonal to the communication-side antenna section 11.

When the rotational angle of the toner supply container 2 changes from the aforesaid 0° to 180°, as described in FIG. 5, the receiving intensity is not less than the value in the case of 0° and not more than the value in the case of 90° or 270°. At the rotational angle of 180°, the RFID tag 20 faces the communication section 10, with the toner supply container 2 existing therebetween. In this state, the directivity of the antenna section 23 is matched with or in parallel to the directivity of the communication-side antenna section 11, but there are intermediates such as the toner supply container 2 and toner between the antenna section 23 and the communication-side antenna section 11. Communication between the antenna section 23 and the communication-side antenna section 11 is still feasible in this state, but the intermediates attenuate an electromagnetic wave for the communication. For this reason, the receiving intensity at the rotational angle of 180° is a value between the receiving intensity at the rotational angle of 0° and the receiving intensity at the rotational angle of 90° or 270°.

The receiving intensity also varies in accordance with an amount of toner in the toner supply container 2. That is to say, the toner in the toner supply container 2 functions as a dielectric layer, attenuating an electromagnetic wave outputted from the antenna section 23 and the communication-side antenna section 11. On this account, the receiving intensity varies in accordance with an amount of toner in the toner supply container 2, as shown in FIG. 5.

More specifically, as shown in FIG. 5, the receiving intensity detected in the communication section 10 attenuates in the following order: in a case where the toner supply container 2 contains no toner (bold full line in the figure), e.g. a spent toner supply container 2; in a case where toner in the toner supply container 2 has been consumed to some degree (thin full line in the figure), e.g. a toner supply container 2 in use; and in a case where the toner supply container 2 is fully filled with toner (dotted line in the figure), e.g. an unused toner supply container 2.

Therefore, in the image forming apparatus 1, the main control apparatus 4 (FIG. 2) detects the receiving intensity in the communication section 10 and the change in the receiving intensity, making it possible to detect the rotational angle of the toner supply container 2. This makes it possible to suitably control at what position the rotation of the toner supply container 2 stops, a timing of communication between the RFID tag 20 and the communication section 10, and the like.

In this manner, the rotational angle of the toner supply container 2 can be controlled by detecting the receiving intensity in the communication between the RFID tag 20 and the communication section 10. More specifically, the main control apparatus 4 (FIG. 2) in the image forming apparatus 1 controls the rotational angle of the toner supply container 2, by utilizing the communication between the RFID tag 20 and the communication section 10.

For instance, in the main control apparatus 4, assume that a position at which the rotation of the toner supply container 2 stops, when the antenna section 23 and the communication-side antenna section 11 face to one another and the directivities of these sections are matched with or in parallel to one another, is set as a rotational angle of 0°. Alternatively, assume that a position, at which the receiving intensity of the toner supply container 2 is maximum according to the rotation of the toner supply container 2 for 360°, is set as a rotational angle of 0°. With the assumption above, the relationship between the rotational angle of the toner supply container 2 and the receiving intensity is described as a graph shown in FIG. 5. Comparing a detected receiving intensity with the graph in FIG. 5, the rotational angle of the toner supply container 2 is determined.

Alternatively, the rotational angle of the toner supply container 2 may be determined by comparing (i) the receiving intensity at the time of performing the communication, with (ii) a graph of receiving intensities in FIG. 5, which has been stored in advance as a table.

However, as shown in the graph in FIG. 5, in a case where the receiving intensity is an absolute value, an error is often observed in the rotational angle detected by the main control apparatus 4, on account of the variations in the outputs from the RFID tag 20 and the communication section 10. To this end, the following arrangement may be adopted. The toner supply container 2 is rotated for 360°, and receiving intensities are measured. A receiving intensity E1 (receiving intensity at a rotational angle of 0°) at a rotational angle θ1, which is the maximum receiving intensity, is determined, and a receiving intensity of E2 (receiving intensity at a rotational angle of 90° or 270°) at a rotational angle θ2, which is the minimum receiving intensity, is also determined. Based on the ratio E2/E1 (hereinafter, referential ratio) of the receiving intensity at the rotational angle θ1 to the receiving intensity at the rotational angle θ2, the rotational angle is determined. More specifically, the ratio of the detected receiving intensity to the receiving intensity E1 at the rotational angle θ1 is figured out, and the rotational angle of the toner supply container 2 is determined by comparing the ratio thus figured out with the referential ratio. In this manner, the detected receiving intensity is represented as a relative value, so that an influence of a variation between receiving intensities of respective apparatuses can be reduced. This makes it possible to precisely determine the rotational angle of the toner supply container 2.

In a case where the directivity of the antenna section 23 is orthogonal to the directivity of the communication-side antenna section 11, communication between the RFID tag 20 and the communication section 10 may be inexecutable. For such a communication failure, the main control apparatus 4 may detect a degree of rotation of the toner supply container 2, in order to precisely detect the rotational angle of the toner supply container 2. This degree of rotation is a value detected in accordance with the rotation of the toner supply container 2. Based on the degree of rotation, the rotational angle of the toner supply container 2 can be determined. To be specific, for instance, the degree of rotation indicates how long the rotation of the toner supply container 2 is carried out, or how much driving power is exerted for driving the toner supply container 2.

To determine the rotational angle of the toner supply container 2 according to the aforesaid degree of rotation, first of all, a position at which the receiving intensity is maximized is determined as a reference. In other words, a position where the antenna section 23 faces the communication-side antenna section 11 and the directivities of these sections are matched with or in parallel to one another is determined as a reference. From this referential position, the measurement of the degree of rotation starts. In accordance with the measured degree of rotation, the rotational angle of the toner supply container 2 is determined.

In the case where the degree of rotation indicates how long the rotation is carried out, first, the main control apparatus 4 starts time measurement from the rotational angle of 0°. The main control apparatus 4 also detects how long the rotation of the toner supply container 2 is carried out. Based on the detected time length of the rotation and a predetermined time required for 360° rotation of the toner supply container 2 (i.e. rotating speed of the toner supply container 2), the main control apparatus 4 determines the rotational angle of the toner supply container 2.

Meanwhile, in the case where the degree of rotation indicates how much driving power is exerted, first, the main control apparatus 4 starts to detect how much driving power is exerted on the toner supply container 2, from the rotational angle of 0°. The main control apparatus 4 detects how much driving power is exerted on the toner supply container 2. This amount of driving power is determined based on a driving power exerted from a driving power source 85 (FIG. 9) provided in the image forming apparatus 1. Subsequently, based on the detected amount of driving power and a predetermined driving power required for 360°rotation of the toner supply container 2, the main control apparatus 4 determines the rotational angle of the toner supply container 2.

When the receiving intensity is optimum, i.e. when the rotational angle of the toner supply container 2 is around 0°, the main control apparatus 4 instructs the RFID tag 20 and the communication section 10 to perform communication therebetween with regard to maintenance information (described later) concerning the toner supply container 2, which is stored in a memory 25 (FIG. 2, described later) of the RFID tag 20. When the rotational. angle is 0°, the antenna section 23 of the RFID tag 20 is matched with or in parallel to the communication-side antenna section 11 of the communication section 10, in terms of directivity. Moreover, between the antenna section 23 and the communication-side antenna section 11, there are no intermediates such as toner that attenuates an electromagnetic wave. It is therefore possible to suitably perform communication with a good S/N ratio.

The optimum receiving intensity is determined for each image forming apparatus 1. That is, for instance, the rotational angle at which the receiving intensity is not less than a predetermined value is determined based on the graph shown in FIG. 5. More specifically, it is determined that information transmission is carried out when the receiving intensity is in a preferable range, e.g. ±30° with respect to the rotational angle of 0°. This ensures that transmitted information always has a good S/N ratio, so that information transmission is highly reliable.

On the contrary, when the rotation angle of the toner supply container 2 is around 90° or around 270°, the main control apparatus 4 prohibits the transmission of the maintenance information. When the rotation angle of the toner supply container 2 is around 90° or around 270°, the antenna section 23 of the RFID tag 20 is orthogonal to the communication-side antenna section 11 of the communication section 10, in terms of the directivity, and hence a state of communication is not good. On this account, information transmission performed at the aforesaid rotational angle is not reliable.

For this reason, when the rotational angle of the toner supply container 2 is around 90° or around 270°, the main control apparatus 4 prevents the RFID tag 20 and the communication section 10 from transmitting information, or causes the RFID tag 20 and the communication section 10 to ignore transmitted maintenance information.

Also in this case, the receiving intensity at which the main control apparatus 4 instructs not to obtain the maintenance information is determined in advance for each image forming apparatus 1. That is to say, for instance, a rotational angle at which the receiving intensity is less than a predetermined value is determined in reference to the graph in FIG. 5. More specifically, when, for instance, the rotational angle of the toner supply container 2 is within a range in which the receiving angle is unsatisfactory, e.g. in a range of ±30° with respect to the rotational angle of 90° or 270°, the main control apparatus 4 instructs not to obtain the maintenance information. With this, since the main control apparatus 4 instructs not to obtain the maintenance information in a condition that the reliability of information transmission is low, the reliability of information transmission between the RFID tag 20 and the communication section 10 is improved.

In the meanwhile, when the rotational angle of the toner supply container 2 is around 180°, the toner supply container 2 and toner exist between the RFID tag 20 and the communication section 10, but the antenna section 23 and the communication-side antenna section 11 are matched with or in parallel to each other, in terms of the directivity. On this account, a state of communication between the RFID tag 20 and the communication section 10 is relatively good in this state. Moreover, since the communication between the RFID tag 20 and the communication section 10 is performed through the intermediary of the toner in the toner supply container 2, the receiving intensity varies in accordance with an amount of toner in the toner supply container 2. On this account, a remaining amount of the toner in the toner supply container 2 can be detected by performing communication between the RFID tag 20 and the communication section 10 while the rotational angle of the toner supply container 2 is around 180°, i.e. when the toner exists between the RFID tag 20 and the communication section 10.

By the way, the toner in the toner supply container 2 is gravitated. Therefore, when the toner supply container 2 is attached to the image forming apparatus 1, the toner accumulates on the lower side of the toner supply container 2. Taking into consideration of this, as shown in FIG. 1(*b*), it is preferable to provide the communication section 10 so as to face the bottom portion of the toner supply container 2, to precisely measure a remaining amount of the toner in the toner supply container 2. With this, a position where the communication section 10 and the RFID tag 20 face one another, with the toner in the toner supply container 2 being existing therebetween, is found while the toner supply container 2 rotates for 360°. Detecting the receiving intensity at that position, it is possible to precisely detect an amount of the toner in the toner supply container 2. Furthermore, this makes it possible to precisely detect an amount of toner even when only a small amount of the toner remains. It is therefore possible to detect a state in which almost all of the toner in the toner supply container 2 has been consumed.

As described above, the image forming apparatus 1 detects the rotational angle of the toner supply container 2 by referring to the communication between the RFID tag 20 and the communication section 10. This allows for the reduction of the number of components of the image forming apparatus 1, and also the reduction in costs.

Now, with regard to the image forming apparatus 1 including the RFID tag 20, the communication section 10, and the toner supply container 2, an arrangement other than the above-described arrangements will be described in detail.

As described above, the RFID tag 20 includes the IC chip 22 and the antenna section 23. As shown in FIG. 2, the IC chip 22 includes a memory (storage section) 25, a receiving circuit 26, a transmitting circuit 27, a power supply circuit 28, and a control circuit 29.

The memory 25 is, for instance, a non-volatile memory storing various types of maintenance information concerning the toner supply container 2. Examples of the maintenance information includes lot numbers such as a company code and a device code, manufacturing date, type of toner, amount of toner, storage period, distinction between used and unused, and the like, which are helpful for using the toner supply container 2 and the toner in the toner supply container 2. The memory 25 is rewritable. On this account, the memory 25 in a used toner supply container 2 can be used again by updating the maintenance information.

The receiving circuit 26 converts a receiving signal received at the antenna section 23, and sends the signal to the control circuit 29. The transmitting circuit 27 converts the signal supplied from the control circuit 29, and sends the signal to the antenna section 23. Furthermore, the power supply circuit 28 rectifies an electric wave for communication, so as to supply power. The control circuit 29 performs the overall control of the RFID tag 20.

The RFID tag 20 is, for instance, attached to the toner supply container 2 using an adhesive, or embedded in the toner supply container 2. The RFID tag 20 is provided at a position on/in the rotating toner supply container 2, where the RFID tag 20 can communicate through electric waves with the communication-side antenna section 11 of the communication section 10. More specifically, the RFID tag 20 is provided on the outer surface of the toner supply container 2 so as to face the communication-side antenna section 11, or in the toner supply container 2 from which the RFID tag 20 can communicate with the communication-side antenna section 11.

As shown in FIG. 2, the communication section 10 is provided with a communication-side receiving circuit 12, a communication-side transmitting circuit 13, a communication-side power supply circuit 14, a communication-side control circuit 15, and an interface circuit 16, in addition to the communication-side antenna section 11.

The communication-side antenna section 11 is capable of performing two-way communication, and is made in such a way that a resin plate is entwined for several times with a metal thin film. The communication-side antenna section 11 is preferably large enough to cover the entirety of an area facing the antenna section 23 of the RFID tag 20.

The communication-side receiving circuit 12 converts a receiving signal received by the communication-side antenna section 11, and sends the signal to the communication-side control circuit 15. The communication-side transmitting circuit 13 converts the signal supplied from the communication-side control circuit 15, and sends the converted signal to the communication-side antenna section 11. The communication-side power supply circuit 14 supplies power to the communication-side receiving circuit 12, the communication-side transmitting circuit 13, the communication-side control circuit 15, and the interface circuit 16. The interface circuit 16 controls data input/output between the main control apparatus 4 of the image forming apparatus 1 and the communication section 10. The communication-side control circuit 15 performs the overall control of the communication section 10.

when the communication-side antenna section 11 of the toner supply container storage section 3 receives information from the RFID tag 20 of the toner supply container 2, the communication-side control circuit 15 outputs information to the main control apparatus 4 of the image forming apparatus 1, via the interface circuit 16. The main control apparatus 4 therefore controls the operation of the image forming apparatus 1, based on the information supplied from the RFID tag 20.

Figure 6:
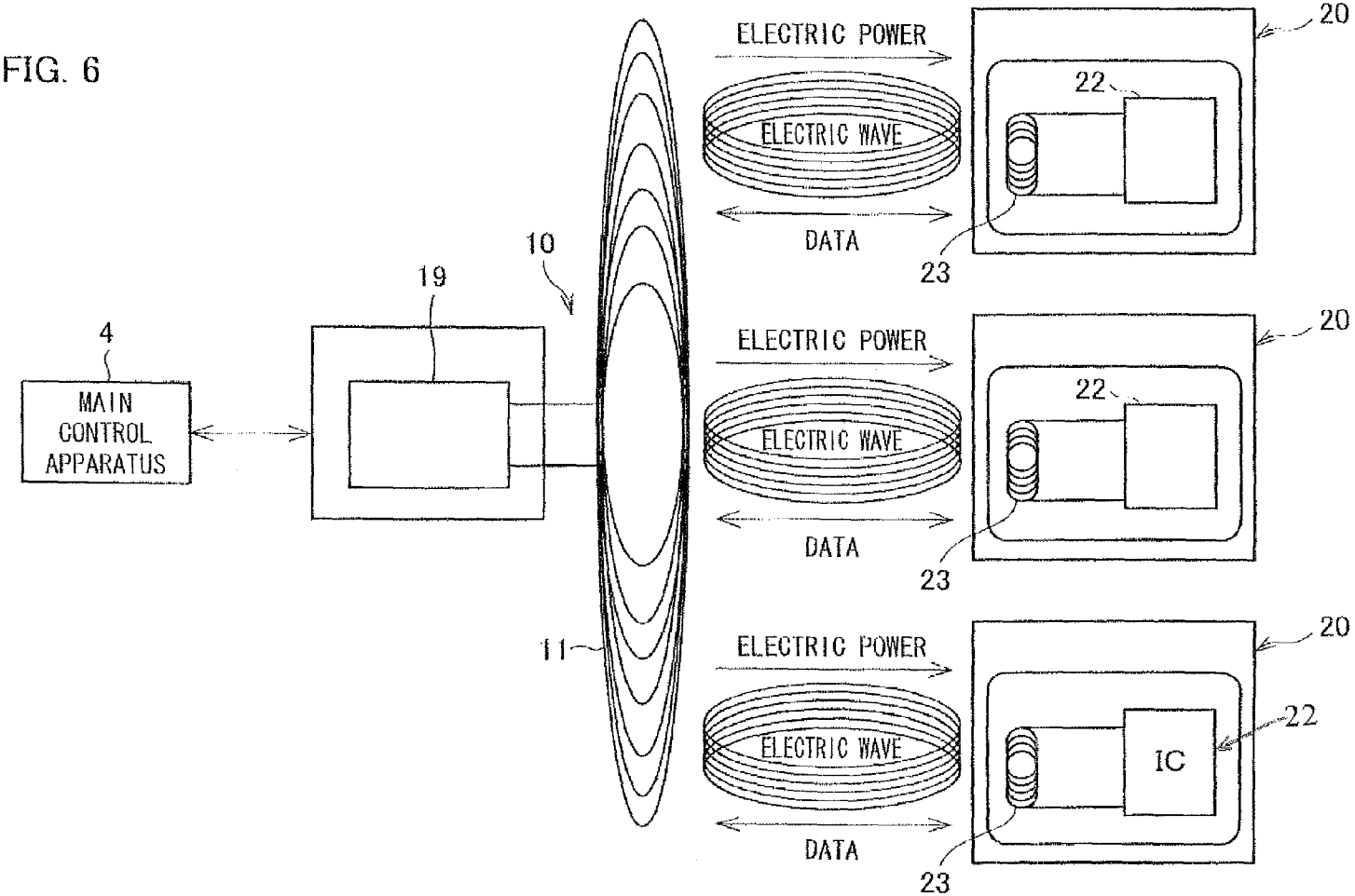
FIG. 6 is a block diagram for illustrating communication between the communication section and a plurality of RFID tags.

The descriptions above takes an example of information transmission between the communication section 10 and one RFID tag 20. Not being limited to this arrangement, however, information transmission may be performed between one communication section 10 and a plurality of RFID tags 20, as shown in FIG. 6. In such a case, the RFID tags 20 may be provided at different positions in a single member of the image forming apparatus 1, or may be provided in different members. In any event, in a case where more than one RFID tag 20 are provided, the RFID tags 20 are provided in consideration of the directivities in the communication by these RFID tags 20 and the directivity in the communication by the communication section 10.

Furthermore, in the case where more than one RFID tag 20 are provided, it is prohibited to simultaneously perform information transmissions between more than one RFID tag 20 and the communication section 10 in order to prevent the decrease in precision of detection on account of crosstalk, and to prevent an error in information detection. That is to say, when information transmission is performed between one RFID tag 20 and the communication section 10, information transmissions between other RFID tags 20 and the communication section 10 are prohibited. On this account, as described above, information transmissions between other RFID tags 20 and the communication section 10 are not performed when, by the RFID tag 20 provided in the toner supply container 2, the rotational angle of the toner supply container 2 is detected or an amount of toner in the toner supply container 2 is detected.

Figure 7:
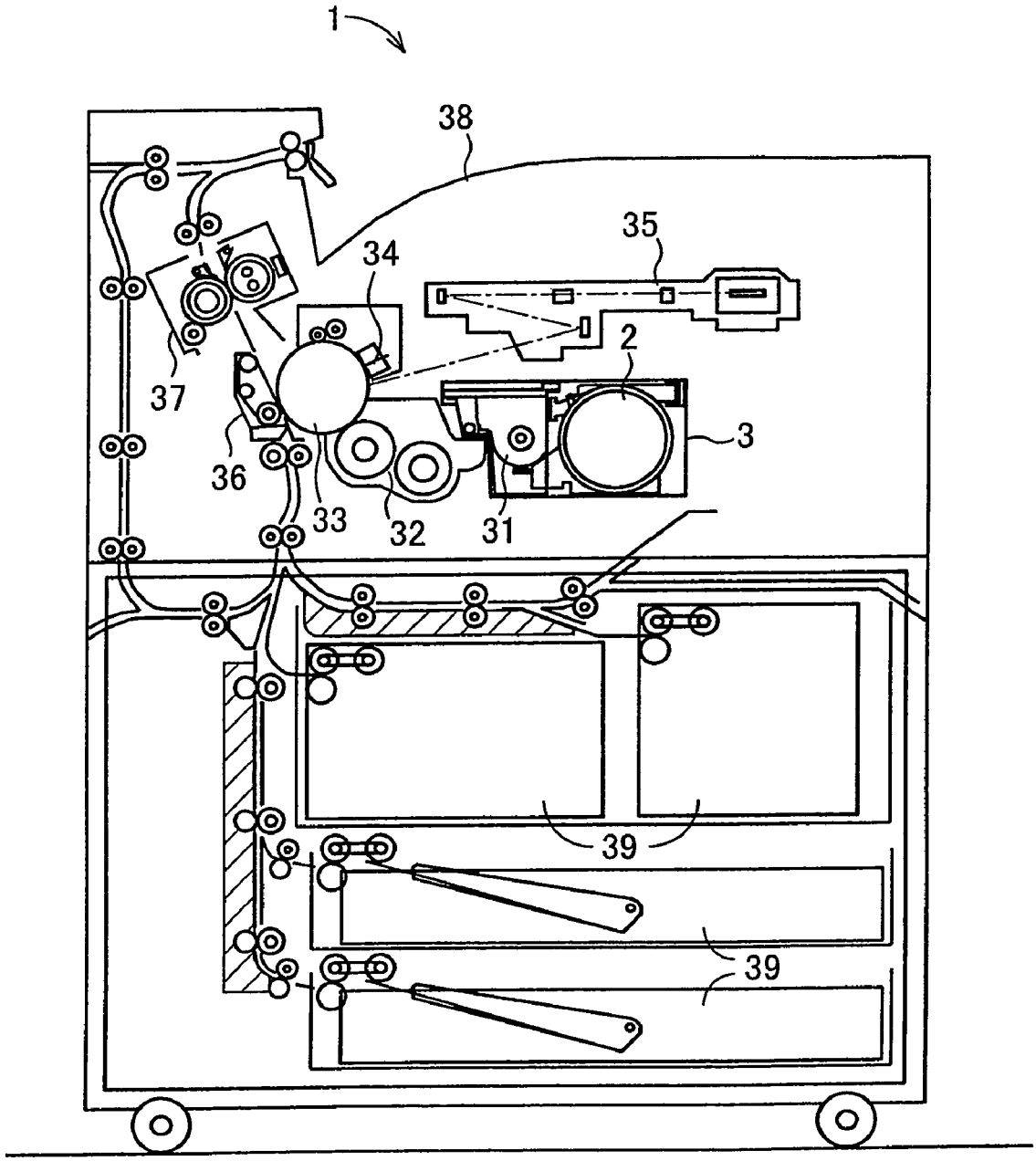
FIG. 7 is a front view roughly illustrating the image forming apparatus.

Now, the image forming apparatus 1 provided with the toner supply container 2 will be described. FIG. 7 is a front view of the image forming apparatus 1, and FIG. 8 is a front view of a substantial part of the image forming apparatus 1.

As shown in FIG. 7, in addition to the toner supply container 2, the image forming apparatus 1 includes: a toner supply container storage section 3 for attaching the toner supply container 2 in a detachable manner; a toner hopper 31; a developer 32; a photosensitive drum 33; a charger 34; an exposure device 35; a transfer unit 36; a fixing section 37; a discharging section 38; and a paper feed section 39.

The toner supply container storage section 3 is provided for attaching the toner supply container 2 to the image forming apparatus 1. As shown in FIG. 7, the toner supply container storage section 3 covers the entirety of the toner supply container 2, so as to fix the toner supply container 2 to the inside of the image forming apparatus 1.

Figure 8:
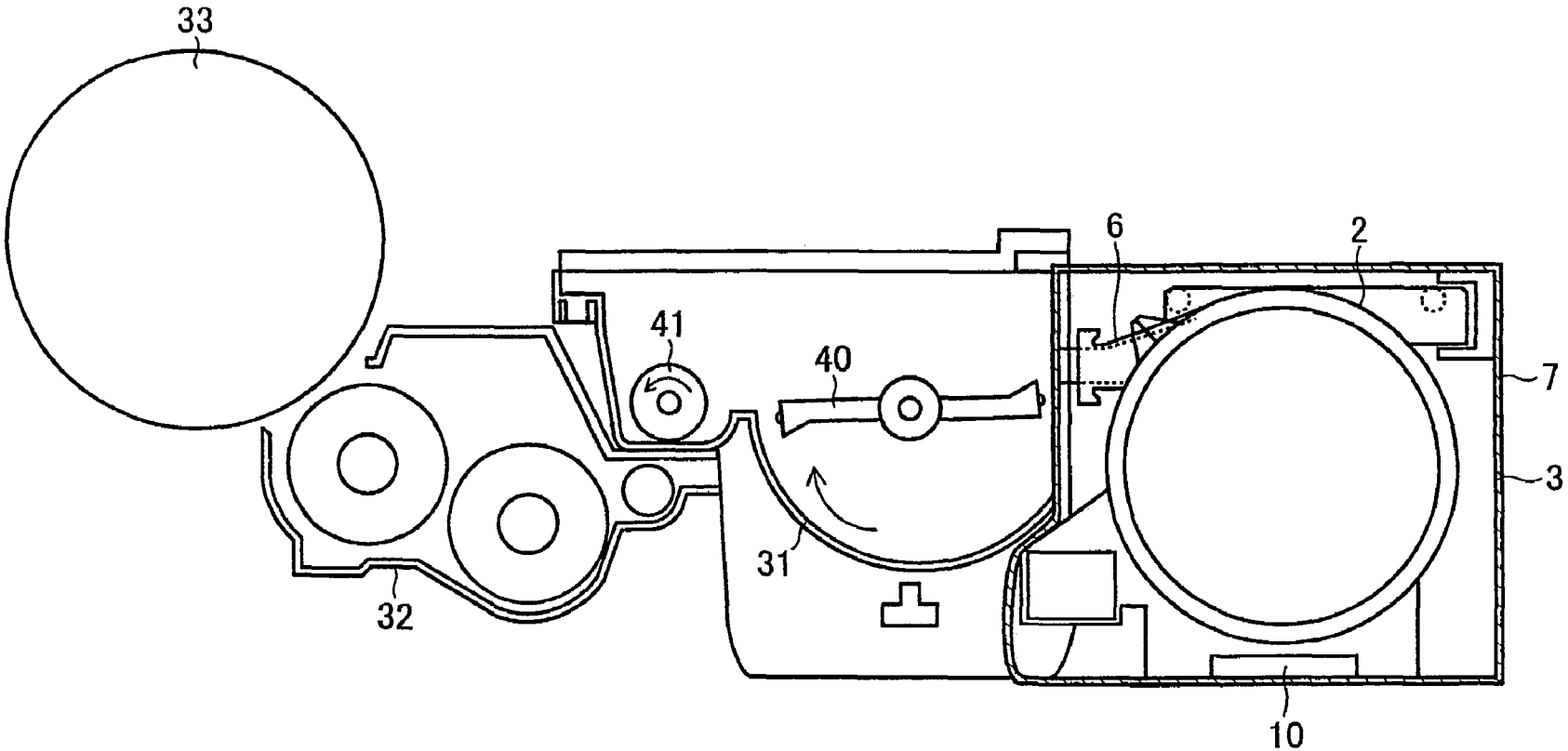
FIG. 8 is a cross section illustrating a substantial part of the image forming apparatus.

As shown in FIG. 8, the toner supply container storage section 3 is provided with the communication section 10 including the communication-side antenna section 11. The communication section 10 is provided inside the toner supply container storage section 3 and on the image forming apparatus side, so as to face the toner supply container 2 in a non-contact manner. The toner supply container 2 is further provided with an electromagnetic shield member 7 which is combined with the toner supply container storage section 3. The electromagnetic shield member 7 covers at least the communication-side antenna section 11 and the RFID tag 20, in order to prevent information transmission between the communication-side antenna section 11 and the RFID tag 20 from being interrupted, in a case where the toner supply container 2 is attached to the toner supply container storage section 3.

This prevents the information transmission between the communication section 10 and the RFID tag 20 of the toner supply container 2 from being influenced by an external electromagnetic wave or the like. This allows for stable wireless communication between the communication section 10 and the RFID tag 20.

The toner hopper 31 stirs toner supplied from the toner supply container 2, and supplies the toner to the following stage. The developer 32 performs development using the toner supplied from the toner hopper 31. The photosensitive drum 33 is an image supporter supporting an electrostatic latent image or a toner image that is formed by developing the electrostatic latent image. The charger 34 shown in FIG. 7 charges the surface of the photosensitive drum 33. The laser exposure device 35 applies a laser beam to the charged photosensitive drum 33, so as to form an electrostatic latent image on the photosensitive drum 33. The transfer unit 36 transfers the toner image on the photosensitive drum 33 to a recording sheet. The fixing section 37 fixes the toner image transferred on the recording sheet, by performing thermo-compression. To the discharging section 38, the recording sheet thus printed (i.e. an image has been formed thereon) is discharged. The paper feed section 39 stores recording sheets.

The image forming apparatus 1 thus arranged performs image formation, in the following manner. First, the charger 34 shown in FIG. 7 charges the surface of the photosensitive drum 33. Then the laser exposure device 35 forms an electrostatic latent image on the photosensitive drum 33, with reference to image information. Meanwhile, toner supplied from the toner supply container 2 to the toner hopper 31 is stirred by an agitator 40 shown in FIG. 8, and then supplied to the developer 32 on account of the rotation of a toner supply roller 41. In the developer 32, the electrostatic latent image formed on the photosensitive drum 33 is developed using the toner supplied from the toner hopper 31, so that a toner image is formed. By the transfer unit 36, the toner image formed on the photosensitive drum 33 is transferred onto a recording sheet transported from the paper feed section 39. The toner image transferred onto the recording sheet is fixed by thermo-compression by the fixing section 37, and discharged to the discharging section 38.

Figure 9:
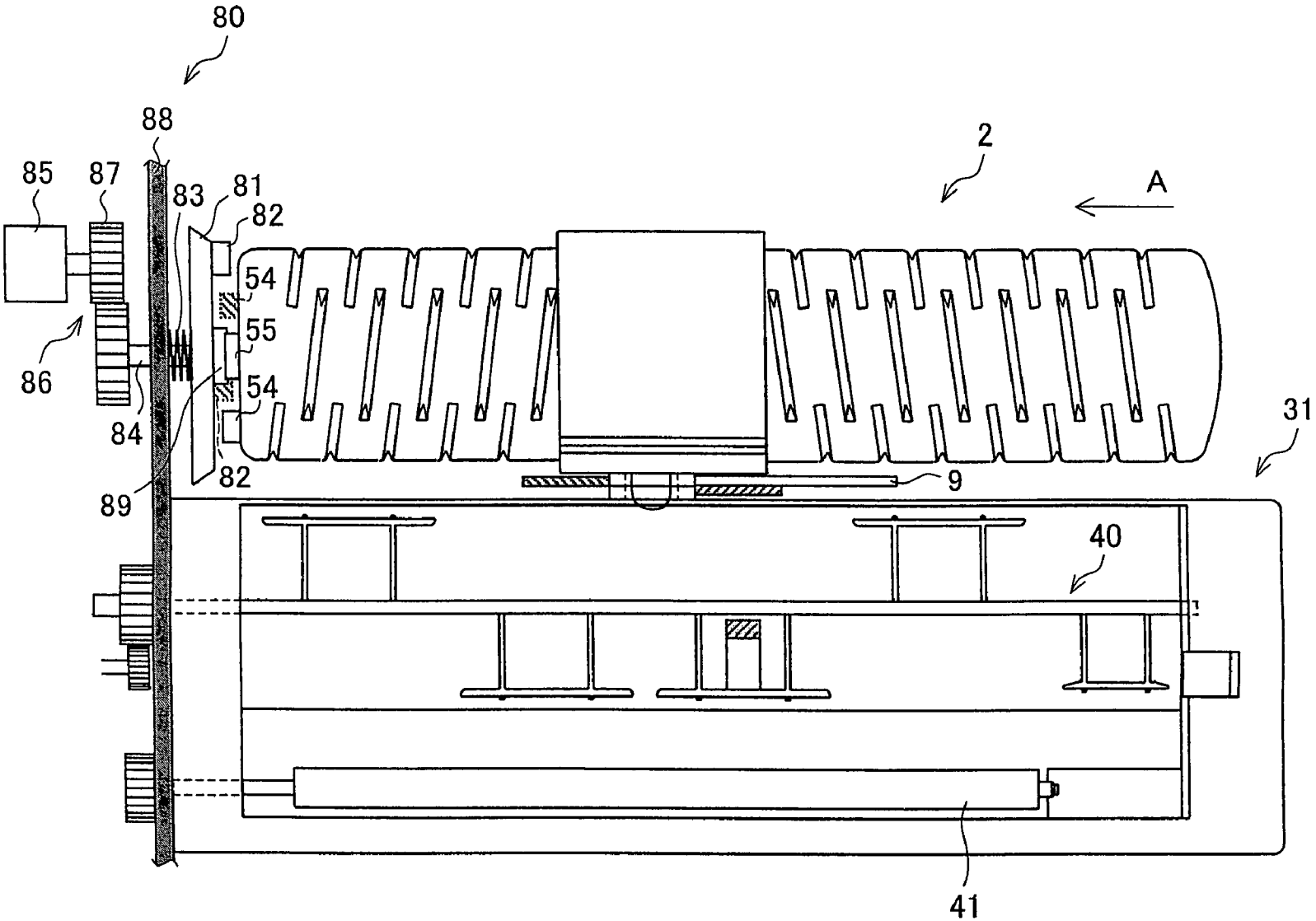
FIG. 9 is a top view illustrating a main-body-side connection section between the toner supply container and the image forming apparatus.
Figure 10:
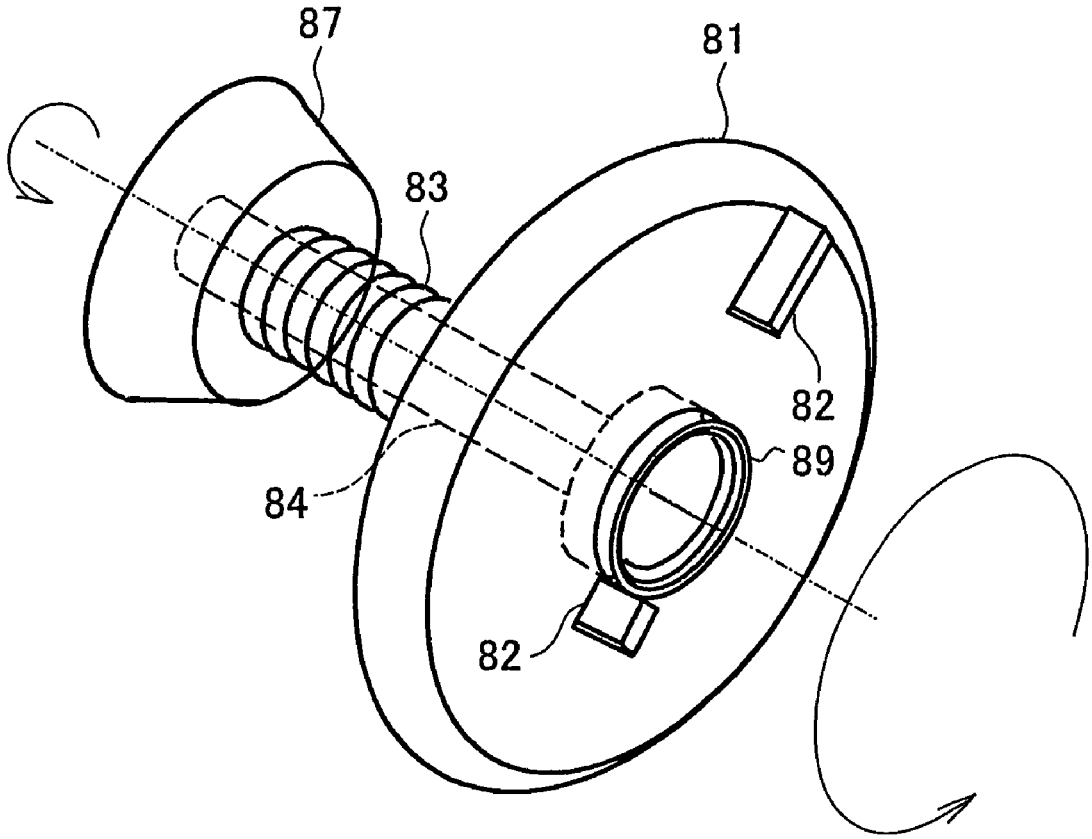
FIG. 10 is an oblique perspective view of a substantial part of the main-body-side connection section.

The toner supply container 2 attached to the image forming apparatus 1 will be described in detail. FIG. 9 is a top view showing a main-body-side connection section 80 of the toner supply container 2 and the image forming apparatus 1. FIG. 10 is an oblique perspective view of a substantial part of the main-body-side connection section 80.

As shown in FIG. 3, the toner supply container 2 has a cylindrical shape, and is supported by a supporting member 5 in such a manner as to be rotatable with respect to a rotational axis L. Along with the supporting member 5, the toner supply container 2 is attached to the toner supply container storage section 3 (FIG. 8) of the image forming apparatus 1, in a detachable manner. On this account, when the toner in the toner supply container 2 runs out, a new toner supply container 2 is attached to the image forming apparatus 1, in order to supply toner.

As shown in FIG. 9, the toner supply container 2 attached to the image forming apparatus 1 is inserted into the image forming apparatus 1 in the direction indicated by an arrow A, so as to be connected to the main-body-side connection section 80 of the image forming apparatus 1. The main-body-side connection section 80 is connected with the toner supply container 2, so as to transfer a driving power from the driving power source 85 (e.g. motor) of the image forming apparatus 1 to the toner supply container 2. As a result, the toner supply container 2 rotates. To achieve this, as shown in FIGS. 9 and 10, the main-body-side connection section 80 includes: a joint receiving section 81 to which the toner supply container 2 is connected; a spring member 83 such as a compression coil; a drive receiving section 87 that receives a driving power from the driving power source 85 (e.g. motor) of the image forming apparatus 1; and a rotational axis 84 that penetrates a housing 88 of the image forming apparatus 1 and connects the joint receiving section 81 with the drive receiving section 87.

The joint receiving section 81 is disk-shaped and rotates around the rotational axis L (FIG. 3) of the toner supply container 2, in response to the driving power from the driving power source 85. Taking into consideration of this arrangement, the joint receiving section 81 is attached to the rotational axis 84 in such a manner as to conform to the center of rotation of the rotational axis 84 penetrating the housing 88 of the image forming apparatus 1. To the joint receiving section 81, the toner supply container 2 is attached in such a manner as to cause the center of rotation of the rotational axis 84 to be matched with the rotational axis L of the toner supply container 2.

On the joint receiving section 81, two joint-side protruding sections 82 for the connection with the toner supply container 2, and a joint-side receiving section 89 are formed.

The rotational axis 84 is provided with the spring member 83 such as a compression coil. The spring member 83 pushes the joint receiving section 81 away from the housing 88. On this account, when the toner supply container 2 is attached to the image forming apparatus 1, a restriction member (not illustrated) restricts the movement of the toner supply container 2 in the direction of attachment to the image forming apparatus 1, in such a manner as to cause the toner supply container 2 to push the joint receiving section 81.

To the drive receiving section 87, a driving power is transferred from the driving power source 85, via a speed reducer 86 such as a gear. The drive receiving section 87 transfers the driving power to the joint receiving section 81, via the rotational axis 84.

Therefore, when the toner supply container 2 is attached to the image forming apparatus 1, the driving power from the driving power source 85 of the image forming apparatus 1 is transferred to the joint receiving section 81, via the speed reducer 86 and the rotational axis 84. This causes the joint receiving section 81 to rotate, thereby causing the toner supply container 2 to rotate around the rotational axis L.

As shown in FIGS. 1(*a*) and 1(*b*), the toner supply container 2 is made up of (i) a first container section 51 and a second container section 52 forming the bottom of the toner supply container 2, and (ii) a third container section 53 provided between the first and second container sections 51 and 52 and is supported by the supporting member 5. The first, second, and third container sections 51, 52, and 53 are integrally molded by blow-molding synthetic resin such as polyethylene.

The first container section 51 is, in the cylindrical toner supply container 2, on the side to which the main-body-side connection section 80 (FIG. 9) of the image forming apparatus 1 is connected. The first container section 51 therefore receives the driving power from the driving power source 85 of the image forming apparatus 1. On this account, formed on the edge portion of the first container section 51, which is the bottom portion of the toner supply container 2, are (i) two protruding sections 54 protruding from the bottom portion, functioning as connection sections for the connection with the below-mentioned main-body-side connection section 80 of the image forming apparatus 1, and (ii) a supply lid 55 which is detachable with respect to a toner supply opening through which toner is supplied to the toner supply container 2.

On this account, as shown in FIG. 9, the joint receiving section 81 of the main-body-side connection section 80 is connected with the toner supply container 2, for instance, in such a manner that the protruding sections 54 and the supply lid 55 on the first container section 51 of the toner supply container 2 are engaged with the joint-side protruding sections 82 and the joint-side receiving section 89 of the joint receiving section 81, respectively.

Meanwhile, as shown in FIG. 1(*a*), the second container section 52 is on a side of the cylindrical toner supply container 2, the side being opposite to the side to which the image forming apparatus 1 is connected.

The first and second container sections 51 and 52 are provided with, on the inner peripheral surfaces, respective transportation sections 56*a* and 56*b* that transport, in response to the rotation of the toner supply container 2, toner from the edge (bottom portion) of the toner supply container 2 to the third container section 53 in the central part of the toner supply container 2. The transportation section 56*a* of the first container section 51 and the transportation section 56*b* of the second container section 52 are tilted for predetermined angles with respect to the direction perpendicular to the rotational axis L of the toner supply container 2, in such a manner as to be symmetrical to each other about the third container section 53 (supporting member 5).

Figure 11:
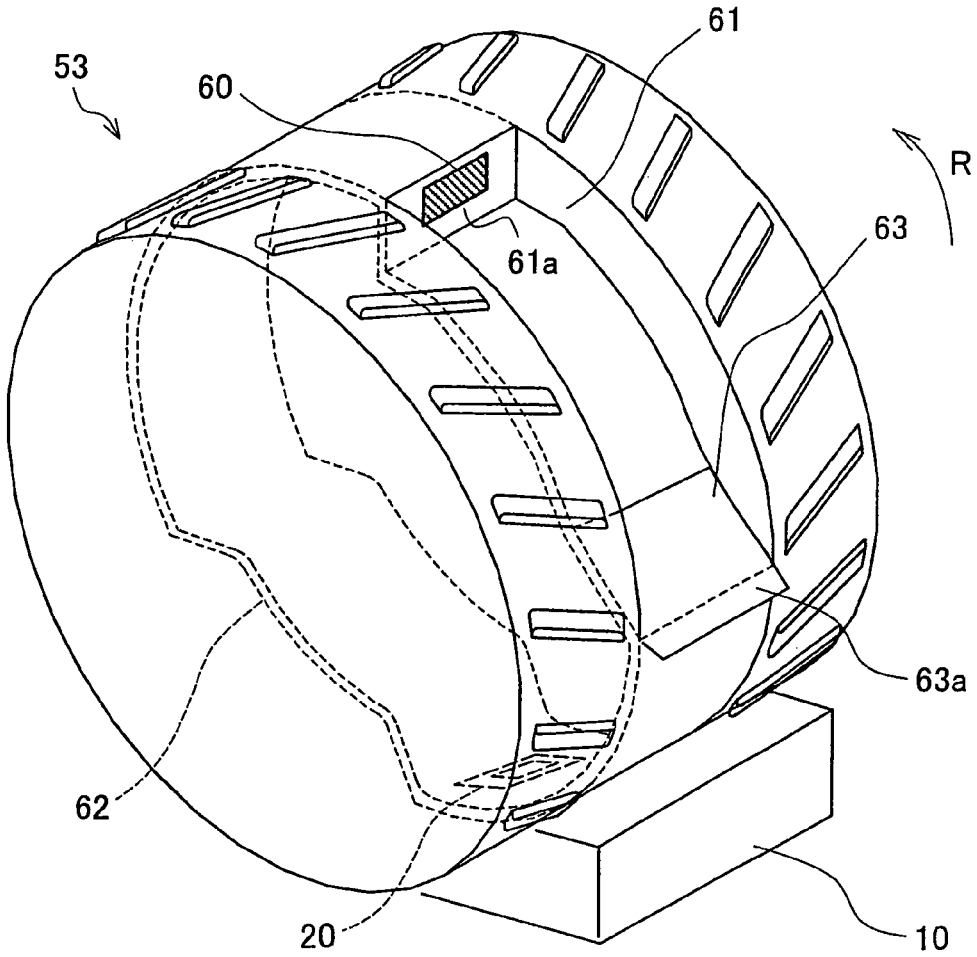
FIG. 11(*a*) is an oblique perspective view of the third container section of the toner supply container.
Figure 11:
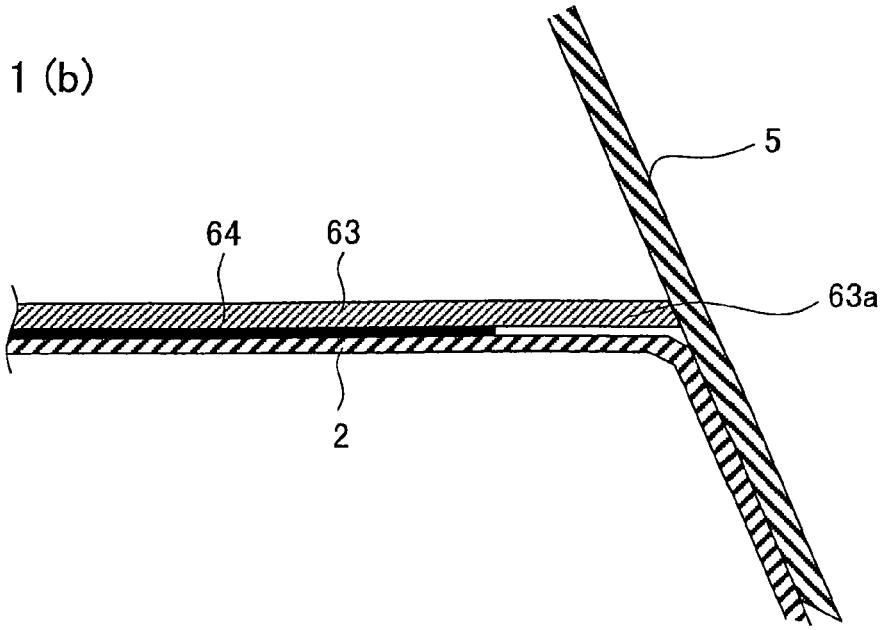
Figure 12:
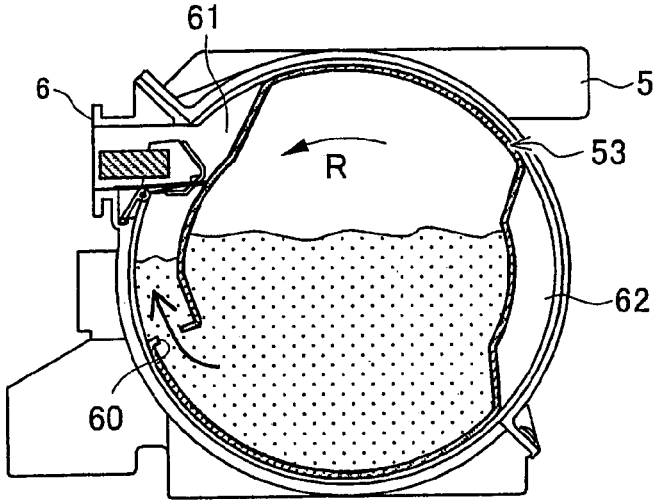
FIGS. 12(*a*)-12(*c*) are cross sections showing how toner is discharged through a toner supply opening of the third container section.
Figure 12:
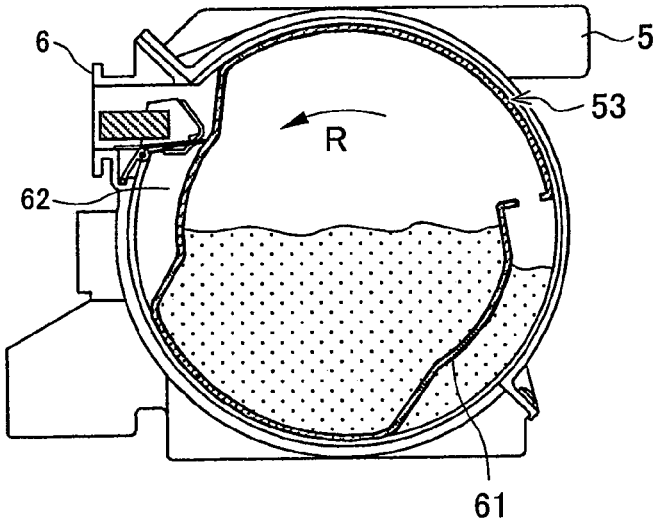
Figure 12:
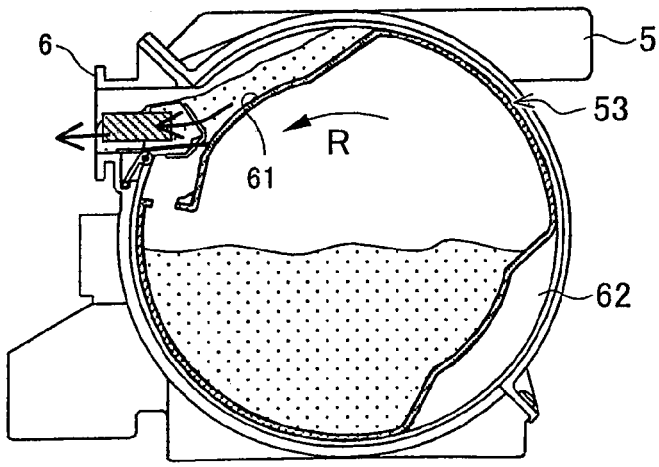

FIG. 11(*a*) is an oblique perspective view of the third container section 53. FIG. 11(*b*) is a cross section of a substantial part of the third container section 53. FIGS. 12(*a*)-12(*c*) are cross sections of the third container section 53.

The third container section 53 is provided between the first and second container sections 51 and 52, and supported by the supporting member 5 as shown in FIG. 1(*a*). As described later in detail, the supporting member 5 is provided with a channel 6 for supplying toner from the toner supply container 2 to the following stage. To supply the toner from the toner supply container 2 to the channel 6, a toner supply opening 60 is formed on the outer peripheral surface of the third container section 53, as shown in FIG. 11(*a*).

As shown in FIG. 11), on the outer peripheral surface of the third container section 53, a first recessed portion 61 and a second recessed portion 62 are formed as recessed portions. These first and second recessed portions 61 and 62 are symmetrical about the rotational axis, and are separated from one another for a predetermined distance.

As described above, the toner supply container 2 thus arranged is supported at the third container section 53 by the supporting member 5, in a rotatable manner (FIG. 3). Since the first and second recessed portions 61 and 62 are formed on the outer peripheral surface of the third container section 53, it is possible to reduce a contact area between the third container section 53 and the supporting member 5 at the time of the rotation of the toner supply container 2. This reduces the friction between the supporting member 5 and the toner supply container 2 at the time of the rotation of the toner supply container 2, allowing the toner supply container 2 to smoothly rotate.

Also, as shown in FIG. 1(*b*), since the third container section 53 is supported by the supporting member 5, upper parts (opening parts) of the first and second recessed portions 61 and 62 are covered with the supporting member 5. That is to say, as shown in FIG. 1(*b*), spaces surrounded by the outer peripheral surface of the third container section 53 and the supporting member 5 are formed at portions of the toner supply container 2 where the first and second recessed portions 61 and 62 are formed.

The space between the first recessed portion 61 and the supporting member 5 is used for retaining the toner discharged from the toner supply container 2 and transporting the toner to the channel 6 of the supporting member 5. That is, as shown in FIG. 11(*a*), the first recessed portion 61 has a toner supply opening 60 on a wall 61*a* on the edge of the toner supply container 2 on the downstream side with respect to the rotational direction R. On this account, as shown in FIG. 12(*a*), when, in accordance with the rotation of the toner supply container 2 in the rotational direction R, the toner supply opening 60 reaches the surface of the toner (shaded region in the figure) in the toner supply container 2, the toner stored in the toner supply container 2 flows into the first recessed portion 61 through the toner supply opening 60. A position of the first recessed portion 61 changes in accordance with the rotation of the toner supply container 2.

On this account, as shown in FIGS. 12(*b*) and 12(*c*), the toner supply container 2 rotates with the toner discharged into the first recessed portion 61 being kept therein. As a result, the toner is transported to the channel 6 of the supporting member 5.

In addition to the above, as FIG. 11(*a*) shows, the first recessed portion 61 is provided with a scraper 63. The scraper 63 is, as shown in FIG. 11(*a*), arranged in such a manner that a tip portion 63*a* protrudes from the outer peripheral surface of the third container section 53, towards the edge of the first recessed portion 61 opposite to the edge where the toner supply opening 60 is formed, i.e. towards the upstream direction of the rotational direction R of the toner supply container 2. On this account, as shown in FIG. 11(*b*), the tip portion 63*a* is in touch with the inner peripheral surface of the supporting member 5.

The scraper 63 is composed of a base film made of polyester and the like. As shown in FIG. 11(*b*), the scraper 63 is fitted in the first recessed portion 61 using an adhesive 64, except the tip portion 63*a*. This arrangement allows the tip portion 63*a* to warp in line with the positional relationship between the toner supply container 2 and the supporting member 5. On this account, the toner supply container 2 rotates with the tip portion 63*a* of the scraper 63 always being in touch with the inner peripheral surface of the supporting member 5.

Therefore, the scraper 63 scrapes the inner peripheral surface of the supporting member 5 in response to the rotation of the toner supply container 2, so that the toner is supplied into the first recessed portion 61. On this account, even if a position of the first recessed portion 61 changes in accordance with the rotation of the toner supply container 2, it is possible to rotate the toner supply container 2 with the toner being kept in the first recessed portion 61, as shown in FIGS. 12(*a*)-12(*c*).

The toner is typically microscopic particles having a grain diameter in the range of several μm to several tens of μm. Therefore, on account of the rotation of the toner supply container 2, the toner may enter a space between (i) the outer peripheral surface of the third container section 53 between the first and second recessed portions 61 and 62 and (ii) the inner peripheral surface of the supporting member 5. In regard to this problem, the scraper 63 is provided so that, when a position of the first recessed portion 61 changes in response to the rotation of the toner supply container 2, the scraper 63 supplies the toner to the first recessed portion side, so as to keep the toner remaining in the first recessed portion 61. This prevents the toner from entering a space between (i) the outer peripheral surface of the third container section 53 between the first and second recessed portions 61 and 62 and (ii) the inner peripheral surface of the supporting member 5.

As shown in FIG. 1(*a*), being different from the first recessed portion 61, the second recessed portion 62 is not provided with a toner supply opening. The toner is therefore not discharged to the second recessed portion 62.

In the present embodiment, as illustrated in FIG. 11(*a*), the RFID tag 20 is provided on the third container section 53, and the communication section 10 is provided so as to face the third container section 53. More specifically, in most cases, the toner supply container 2 preferably stops the rotation when the toner supply opening 60 is positioned at the highest point, as shown in FIG. 1(*b*). This is because, as described in reference to FIGS. 12(*a*)-12(*c*), toner is stored in the first recessed portion 61 of the third container section 53 and supplied to the channel 6 of the supporting member 5, as in the case of the above-described toner supply container 2.

That is to say, in the toner supply container 2, it is important to stably supply the toner to the channel 6 of the supporting member 5, in line with the rotation of the toner supply container 2. To stably supply the toner, it is necessary to control at what position the rotation of the toner supply container 2 stops.

More specifically, when a long period of time elapses after the toner supply container 2 stops the rotation at a position where the toner flows into the first recessed portion 61 through the toner supply opening 60, the toner coagulates in the first recessed portion 61 on account of the weight of the toner and a pressure on account of the weight of the toner. In this state of toner coagulation in the first recessed portion 61, even if the toner supply is resumed by rotating the toner supply container 2, the toner does not flow out from the first recessed portion 61, so that toner supply cannot be stably performed. Therefore, when the rotation of the toner supply container 2 is stopped, it is necessary to stop the rotation of the toner supply container 2 at a position where the toner does not flow in through the toner supply opening 60. On this account, the toner supply container 2 is, as shown in FIG. 1(*b*), typically attached to the image forming apparatus 1 and stops the rotation, in such a manner that the toner supply opening 60 is positioned at the highest point.

As described above, when the toner supply container 2 is attached to the image forming apparatus 1, as shown in FIG. 1(*b*), the toner supply opening 60 is positioned at the highest point. Also, immediately after attaching the toner supply container 2 to the image forming apparatus 1, information transmission regarding maintenance information of the toner supply container 2 is preferably performed between the RFID tag 20 and the communication section 10. Therefore, as shown in FIG. 11(*a*), the RFID tag 20 is preferably at the closest to the communication section 10, i.e. the RFID tag 20 preferably faces the toner supply opening 60 with the rotational axis L existing therebetween, when the toner supply opening 60 is positioned at the highest point.

Now, the supporting member 5 for supporting the toner supply container 2 will be discussed. As shown in FIG. 1(*b*), the supporting member 5 is provided with the channel 6 used for supplying, to the toner hopper 31, the toner discharged from the toner supply container 2. This channel 6 faces the toner hopper 31. Also, the channel 6 is above the rotational axis of the toner supply container 2 as shown in FIG. 1(*b*), when the toner supply container 2 is attached to the image forming apparatus 1.

As shown in FIGS. 3 and 9, the supporting member 5 is further provided with a shutter 9 for opening and closing the channel 6. The shutter 9 is in the open state when the toner supply container 2 is attached to the image forming apparatus 1. Meanwhile, the shutter 9 is in the closed state when the toner supply container 2 is not attached to the image forming apparatus 1. More specifically, as the toner supply container 2, along with the supporting member 5, is inserted in the direction of an arrow A in FIG. 9 into the toner supply container storage section 3 in the image forming apparatus 1, the shutter 9 slides along the direction of the insertion. Once the toner supply container 2 is completely attached, the shutter 9 is in the open state. Through this opened shutter 9, toner can be supplied from the channel 6 to the toner hopper 31. In the meanwhile, when the toner supply container 2 is detached from the image forming apparatus 1, the shutter 9 slides so as to cover the channel 6, i.e. the shutter 9 is closed. In this manner, since the channel 6 is covered with the shutter 9, it is possible to prevent the toner from flowing out from the toner supply container 2.

Figure 13:
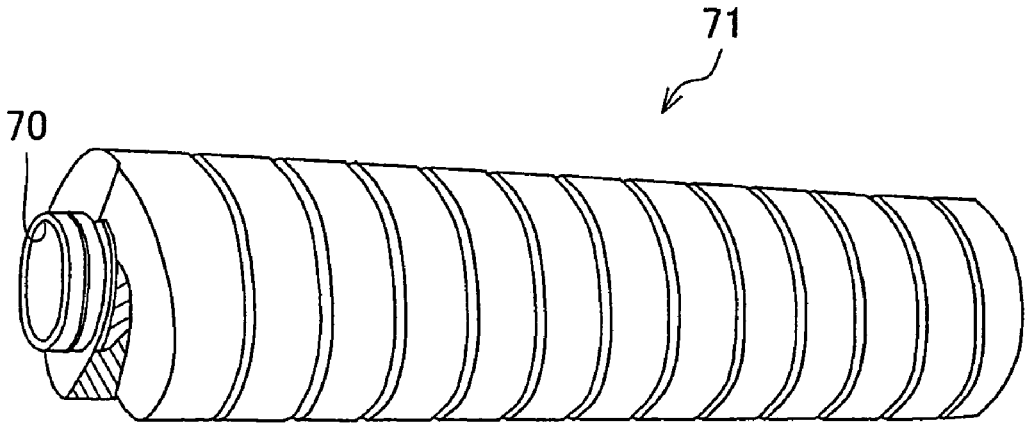
FIG. 13 is an oblique perspective view of a toner supply container of another example embodiment.

In the present embodiment, as shown in Eigs. 1(*a*) and 1(*b*), the toner supply container 2 is arranged such that the toner supply opening 60 is made in the third container section 53. However, the present invention is not limited to this embodiment. As shown in FIG. 13, the following arrangement may be adopted: a toner supply container 71 is arranged such that a toner supply opening 70 is made at the edge portion of the toner supply container 71, and an RFID tag is provided on such a toner supply container 71.

A position of the RFID tag on the toner supply container is optionally determined on condition that the position of the RFID tag changes in accordance with the rotation of the toner supply container. Therefore, rather than on the outer peripheral surface of the third container section 53 as shown in FIG. 11(*a*), the RFID tag 20 may be provided on the first container section 51 or the second container section 52, However, to accurately detect an amount of toner in the toner supply container 2, the RFID tag 20 is preferably provided in the vicinity of the toner supply opening 60 through which the toner is discharged. In other words, the antenna section 23 and the communication-side antenna section 11 are preferably provided in such a way as to allow the RFID tag 20 and the communication section 10 to communicate with each other over the toner which is accumulated in the toner supply opening 60 and/or the toner in the vicinity of the toner supply opening 60.

More specifically, as shown in FIG. 11(*a*), the RFID tag 20 is preferably provided on the peripheral surface of the third container section 53, where the toner supply opening 60 is made. In the case of the toner supply container 71 shown in FIG. 13, the RFID tag 20 is preferably provided in the vicinity of the toner supply opening 70. This allows the toner to be supplied to the toner supply opening 70, thereby making it possible to accurately detect an amount of toner even when a remaining amount of the toner in the toner supply container 71 is small.

The toner may be nonmagnetic or magnetic toner used for single-component development and two-component development, or a two-component developing agent made up of toner and carrier.

The descriptions above are given on the premise that a toner supply container functions as the content storage member and the rotating member. However, the content storage member/rotating member is not limited to this toner supply container, on condition that content of the rotating member varies in accordance with the rotation of the image forming apparatus 1. Note that, "variation of content" indicates either decrease or increase of the content.

The content storage member may be, for instance, a toner hopper 31 or a developer 32 shown in FIG. 8. Moreover, although not illustrated, the content storage member may be a toner recovery container of a cleaning unit for removing toner adhered to the photosensitive drum 33, a staple storage member of a post-treatment device performing stapling and punching, or a punch dust storage member of the post-treatment device. The content storage member may also be an ink cartridge of an inkjet printer, which stores ink.

The aforesaid rotating member is, for instance, the photosensitive drum 33, the agitator 40 of the toner hopper 31, the toner supply roller 41 of the toner hopper 31, or a developing roller in the developing unit 32. In a case where the RFID tag is provided on an agitating member such as the agitator 40, the toner supply roller 41, and the developing roller, it is possible to measure an amount of toner in the toner hopper 31 or the developing unit 32. Not limited to an amount of toner, it is possible to measure content (e.g. ink) of an ink cartridge of an inkjet printer.

The aforesaid rotating member is, for instance, the photosensitive drum 33, the agitator 40 of the toner hopper 31, the toner supply roller 41 of the toner hopper 31, or a developing roller in the developer 32. In a case where the RFID tag 20 is provided on an agitating member such as the agitator 40, the toner supply roller 41, and the developing roller, it is possible to measure an amount of toner in the toner hopper 31 or the developer 32. Not limited to an amount of toner, it is possible to measure content (e.g. ink) of an ink cartridge of an inkjet printer.

The first image forming apparatus of an example embodiment includes a content storage member that stores predetermined content and is provided with a communication element, and a communication section that communicates with the communication element in a non-contact manner, the first image forming apparatus further comprising a detection section that measures the content of the content storage member by detecting a state of communication between the communication element and the communication section.

The detection section measures the content of the content storage member, with reference to a change in the receiving intensity of a communication wave used for the communication.

According to this arrangement, the content storage member stores the content. On this account, the state of the communication between the communication element and the communication section changes in accordance with an amount of the content of the content storage member. More specifically, the receiving intensity of the communication wave used for the communication changes.

For this reason, the image forming apparatus obtains information with regard to an amount of the content of the content storage member, by detecting, using the detection section, a change in the state of the communication between the communication element and the communication section, e.g. a change in the receiving intensity of the communication wave. The arrangement above therefore makes it possible to measure the content by detecting a change in the state of the communication between the communication element and the communication section that perform communication in a non-contact manner.

On this account, not only the information transmission but also the measurement of the content are achieved using the communication element and the communication section, so that the image forming apparatus can be structurally simplified. Also, since the number of components is reduced on account of the above, it is possible to lower the cost of the image forming apparatus.

In the aforesaid image forming apparatus of an example embodiment, the communication element preferably includes a storage section storing maintenance information of the content storage member, and an antenna section.

According to this arrangement, the communication element includes a storage section storing maintenance information. For this reason, the image forming apparatus can read/write the maintenance information to/from the storage section, by means of the communication between the communication section and the communication element.

The aforesaid image forming apparatus of an example embodiment is preferably arranged such that, the communication section includes a communication device for communicating with the antenna section of the communication element, and the communication device is so positioned as to be capable of communicating with the antenna section, over the content.

According to this arrangement, the communication between the antenna section and the communication device is performed over the content. On this account, a state of this communication highly precisely reflects an amount of the content. Taking account of this, the content of the content storage member can be highly precisely measured by performing the communication between the antenna section and the communication device.

The aforesaid image forming apparatus is preferably arranged such that, the content storage member rotates in the image forming apparatus, the communication section includes a communication device for communicating with the antenna section of the communication element, and the communication device is so positioned as to be capable of communicating with the antenna section over the content, at least once in 360° rotation of the content storage member.

According to this arrangement, since the content storage member rotates, the position of the communication element changes in accordance with the rotation of the content storage member, and consequently relative positions of the communication element and the communication section change. This results in a change in the state of the communication between the communication element and the communication section. On this account, the antenna section and the communication device are so positioned as to face each other at least once in the rotation of the content storage member.

On this account, even if the content storage member rotates, the antenna section and the communication device can suitably perform communication therebetween, at positions where the antenna section and the communication device face each other. This makes it possible to perform, using the communication element and the communication section, information transmission such as reading and writing of maintenance information from/to the storage section of the communication element, even when the content storage member to which the communication element is attached rotates.

The aforesaid image forming apparatus is preferably arranged such that, the directivity in communication by the antenna section is matched with or in parallel to the directivity in communication by the communication device, when the antenna section and the communication device face each other.

According to this arrangement, the antenna section and the communication device are so positioned as to allow the directivity of the antenna section to be matched with or in parallel to the directivity of the communication device. When these directivities are matched with or in parallel to each other, the communication between the antenna section and the communication device is suitably performed. It is therefore possible to realize highly-reliable information transmission by positioning the antenna section and the communication device in such a manner that the directivities of these members are in parallel to or matched with each other when the antenna section and the communication face each other. On this account, the communication with a good S/N ratio is realized when maintenance information stored in the storage section is read out from the storage section or information is written into the storage section, by means of the communication between the communication device of the communication section and the communication element.

The aforesaid image forming apparatus may be arranged such that, the content is a developer and the content storage member is a developer supply container for supplying the developer to the image forming apparatus.

According to this arrangement, the developer supply container stores the developer therein. On this account, a remaining amount of the developer in the developer supply container can be measured with reference to the communication between the communication device of the communication section and the communication element.

The aforesaid image forming apparatus of an example embodiment is preferably arranged such that, the content is a developer, the content storage member is a developer supply container for supplying the developer to the image forming apparatus, the developer supply container has a developer supply opening through which the developer is supplied, the developer supply container stops the rotation when the developer supply opening is at a predetermined position, and the antenna section and the communication device face each other when the developer supply opening is at that predetermined position.

To prevent accumulation and coagulation of the developer in the developer supply container, and also leakage of the developer from the developer supply container, it is sometimes necessary to stop the rotation when the developer supply opening is at a predetermined position. According to the aforesaid arrangement, the developer supply opening is at that predetermined position when, for instance, the developer supply container is attached to the image forming apparatus. Also, when the developer supply apparatus is attached, the communication element and the communication section perform communication in order to supply maintenance information from the communication element.

On this account, according to the arrangement above, the antenna section and the communication device face each other when the developer supply opening is at the predetermined position, in order to allow for prompt acquisition of maintenance information when transmission of the maintenance information is required between the communication element and the communication section. It is therefore possible to speedily perform the communication between the communication element and the communication section, with a high reliability.

The aforesaid image forming apparatus of the an example embodiment is preferably arranged such that, the antenna section and the communication device are so positioned as to be capable of communicating with each other, over the developer accumulated at the developer supply opening of the developer supply container.

According to this arrangement, the developer in the developer supply container is transported to the developer supply opening. On this account, the developer exists at the developer supply opening, even when only a little amount of the developer remains in the developer supply container. According to this arrangement, it is possible to precisely measure a remaining amount of the developer even if only a little amount of the developer remains in the developer supply container, because the developer at the developer supply opening is measured.

The aforesaid image forming apparatus of an example embodiment may further include an electromagnetic shield member that covers at least the communication element and the communication device.

According to this arrangement, the electromagnetic shield member covering the communication element and the communication device is provided in such a way as to isolate the communication element and the communication device from an external electromagnetic wave and magnetic field. On this account, the electromagnetic shield member shields the external electromagnetic wave and magnetic field, when the communication element and the communication device wirelessly communicate with each other. This allows the communication element and the communication device to stably perform information transmission, because an obstruction of information exchange and a communication error are eliminated.

A content measurement method of an example embodiment, for an image forming apparatus including: a content storage member that stores predetermined content and has a communication element; and a communication section that communicates, in a non-contact manner, with the communication element, is arranged in such a manner that, the content of the content storage member is measured based on a state of communication between the communication element and the communication section.

According to this method, the content of the content storage member can be measured using the communication element and the communication section provided for information transmission. Therefore, both the information transmission and the measurement of the content of the content storage member can be achieved using the communication element and the communication section. On this account, it is possible to structurally simplify the image forming apparatus, and lower the cost of the image forming apparatus.

The aforesaid content measurement method may be arranged such that, the content storage member rotates in the image forming apparatus, and as the state of the communication, the receiving intensity of a communication wave used for the communication is detected while the content storage member rotates for 360°.

According to this method, when the content storage member rotates, the state of the communication, which changes in accordance with the rotation of the content storage member, is detected. On this account, when the content storage member to which the communication element is attached rotates, it is possible to detect the rotational angle of the content storage member, by means of the communication element and the communication section. It is therefore possible to control the rotation of the content storage member, by detecting the rotational angle of the content storage member.

The aforesaid content measurement method may be arranged such that, the maximum value and the minimum value of the receiving intensity while the content storage member rotates for 360° are determined, and the rotation of the content storage member is controlled in accordance with the ratio between the maximum value and the minimum value of the receiving intensity.

According to this method, the rotational angle of the content storage member can be detected in reference to a relative value of the receiving intensity. This makes it possible to precisely control the rotation of the content storage member, by restraining variations in the detected communication wave and receiving intensity, with regard to the communication between the communication element and the communication section.

The aforesaid content measurement method may be arranged such that, the communication element includes a storage section storing maintenance information of the content storage member, and the communication control is performed in such a manner that the transmission of the maintenance information between the communication element and the communication section is performed when the receiving intensity is not lower than a predetermined value.

According to this method, the transmission of the maintenance information is performed when the receiving intensity is good. On this account, the transmission of the maintenance information is highly reliable.

The aforesaid content measurement method of an example embodiment may be arranged such that, the communication element includes a storage section storing maintenance information of the content storage member, and communication control is performed so as to prevent the maintenance information from being fetched from the communication element, when the receiving intensity is not higher than a predetermined value.

According to this arrangement, the transmission of the maintenance information is not performed when the receiving intensity is unsatisfactory. Alternatively, the acquisition of the maintenance information is not performed as the maintenance information acquired through the communication is ignored. This prevents the content storage member and the image forming apparatus from malfunctioning on account of the information acquired through the communication.

The second image forming apparatus of an example embodiment comprises: a rotating member which is rotatable in the image forming apparatus and has a communication element; a communication section communicating with the communication element in a non-contact manner; and a detection section that detects a rotational angle of the rotating member by detecting a state of communication between the communication element and communication section.

The detection section detects the rotational angle of the rotating member, in accordance with a change in the receiving intensity of a communication wave used for the communication.

According to the arrangement above, the communication element is attached to the rotating member. On this account, in accordance with the rotation of the rotating member, relative positions of the communication element and communication section change. Therefore, the state of the communication between the communication element and communication section also changes. More specifically, the receiving intensity of the communication wave used for the communication changes.

For the reason above, in the image forming apparatus, information with regard to the rotational angle of the rotating member is obtained by the detection section detecting a change in the state of the communication between the communication element and the communication section, e.g. by detecting a change in the receiving intensity of the communication wave. Therefore, according to the arrangement above, the rotational angle of the rotating member can be detected by detecting a change in the state of the communication between the communication element and communication section which perform communication therebetween in a non-contact manner.

Therefore, according to the arrangement above, since not only the communication but also the rotational angle of the rotating member can be detected using the communication element and the communication section, the image forming apparatus can be structurally simplified. Also, since this reduces the number of components, it is possible to lower the cost of the image forming apparatus.

In the aforesaid image forming apparatus of an example embodimentn the detection section may additionally detect the degree of rotation of the rotating member.

The degree of rotation is, for instance, how long the rotation of the rotating member is carried out or how much driving power is exerted for driving the rotating member.

According to the arrangement above, the detection section detects the degree of rotation of the rotating member. Therefore, the rotational angle of the rotating member can be detected by detecting the degree of rotation from the start of the rotation of the rotating member. With this, it is possible to precisely detect the rotational angle of the rotating member even when it is impossible to perform the communication between the communication element of the rotating member and the communication section.

The aforesaid image forming apparatus of an example embodiment is preferably arranged such that the communication element includes: a storage section storing maintenance information of the attached member; and an antenna section.

According to this arrangement, the communication element includes a storage section storing maintenance information. This allows the image forming apparatus to read the maintenance information from the storage section or to write the information into the storage section, through the communication between the communication section and the communication element.

The aforesaid image forming apparatus of an example embodimentxt is preferably arranged such that the communication section includes a communication device for communicating with the antenna section of the communication element, and the communication device is so positioned as to face the antenna section at least once in 360° rotation of the rotating member.

According to this arrangement, the antenna section and the communication device face each other at least once while the rotation of the rotating member. On this account, the antenna section and the communication device can suitably perform communication therebetween when the antenna section and the communication device face each other. Therefore, even when the rotating member is provided with the communication element, the communication such as reading and writing of the maintenance information from/to the storage section of the communication element can be suitably performed using the communication element and the communication section.

The aforesaid image forming apparatus of an example embodiment is preferably arranged such that the directivity in communication by the antenna section is matched with or in parallel to the directivity in communication by the communication device, when the antenna section and the communication device face each other.

According to this arrangement, the antenna section and the communication device are so positioned as to allow the directivity of the antenna section to be matched with or in parallel to the directivity of the communication device. When these directivities are matched with or in parallel to each other, the communication between the antenna section and the communication device is suitably performed, so that highly-reliable information transmission is realized. On this account, the communication with a good S/N ratio is realized when the maintenance information stored in the storage section is read out or the information is written into the storage section, by means of the communication between the communication device of the communication section and the communication element.

The aforesaid image forming apparatus of an example embodiment may be arranged such that the rotating member stores predetermined content.

In the aforesaid case, the antenna section and the communication device are preferably so positioned as to face each other over the content of the rotating member, at least once in 360° rotation of the rotating member.

According to this arrangement, the state of the communication between the antenna section and the communication device changes in accordance with an amount of the content of the rotating member. It is therefore possible to measure the content of the rotating member by performing, over the content, the communication between the antenna section and the communication device.

The aforesaid image forming apparatus is preferably arranged such that the aforesaid content is a developer, and the rotating member is a developer supply container that supplies the developer to the image forming apparatus.

According to this arrangement, the developer supply container supplies the developer by rotating in the image forming apparatus. On this account, it is sometimes necessary to control at what position the rotation of the developer supply container stops and the rotational angle of the developer supply container, in order to prevent accumulation and coagulation of the developer in the developer supply container, and also to prevent leakage of the developer from the developer supply container. It is therefore possible to control at what position the rotation of the developer supply container stops and the rotational angle of the developer supply container, by detecting the rotational angle of the developer supply container, using the communication element provided on the developer supply container as described above.

Also, since the developer is consumed in accordance with the operation of the image forming apparatus, it is possible to detect a remaining amount of the developer in the developer supply container, using the communication element and the communication section.

The aforesaid image forming apparatus of an example embodiment may be arranged such that, the developer supply container has a developer supply opening through which the developer is supplied to the image forming apparatus, the rotation of the developer supply container stops when the developer supply opening is at a predetermined position, and the antenna section and the communication device face each other when the developer supply opening is at that predetermined position.

According to this arrangement, the developer supply opening is at the predetermined position when, for instance, the developer supply container is attached to the image forming apparatus. When the developer supply container is attached, information transmission is performed between the communication element and the communication section in order to supply the maintenance information from the communication element. In such a case, in order to promptly supply the maintenance information at the time of attaching the developer supply container, the antenna section and the communication device face each other when the developer supply opening is at the predetermined position. This realizes speedy and highly-reliable information transmission between the communication element and the communication section.

A method of controlling rotation of an example embodiment, for an image forming apparatus including: a rotating member that is rotatable in the image forming apparatus and has a communication element, and a communication section that communicates, in a non-contact manner, with the communication element, is arranged such that, rotation of the rotating member is controlled based on a state of communication between the communication element and the communication section.

According to this method, the rotational angle of the rotating member can be controlled using the communication element and communication section provided for information transmission. Therefore, both the control of the information transmission and the control of the rotation of the rotating member can be achieved using the communication element and the communication section. On this account, it is possible to structurally simplify the image forming apparatus, and lower the cost of the image forming apparatus.

The aforesaid method of controlling rotation may be arranged such that, as the state of the communication, the receiving intensity of a communication wave used for the communication is detected, while the rotating member rotates for 360°.

According to this method, it is possible to detect the receiving intensity that changes in accordance with a change in the rotational angle of the rotating member. It is therefore possible to control the rotation of the rotating member, by detecting the rotational angle of the rotating member.

The aforesaid method of controlling rotation may be arranged such that, the maximum value and the minimum value of the receiving intensity while the rotating member rotates for 360° are determined, and the rotation of the rotating member is controlled in accordance with the ratio between the maximum value and the minimum value of the receiving intensity.

According to this method, the rotational angle of the rotating member can be detected in reference to a relative value of the receiving intensity. This makes it possible to precisely control the rotation of the rotating member, by restraining variations in the detected communication wave and receiving intensity with regard to the communication between the communication element and the communication section.

The aforesaid method of controlling rotation may be arranged such that, the communication element includes a storage section storing maintenance information of the rotating member, and communication control is performed in such a manner as to cause the communication element and the communication section to perform transmission of the maintenance information, when the receiving intensity is not lower than a predetermined value.

According to this method, the transmission of the maintenance information is performed when the receiving intensity is good. On this account, the transmission of the maintenance information is highly reliable.

The aforesaid method of controlling rotation may be arranged such that, the communication element includes a storage section storing maintenance information of the rotating member, and communication control is performed so as to prevent the maintenance information from being fetched from the communication element, when the receiving intensity is not higher than a predetermined value.

According to this arrangement, the maintenance information is not acquired when the receiving intensity is unsatisfactory, by not performing the transmission of the maintenance information or by ignoring the maintenance information acquired by the communication. This prevents the rotating member and the image forming apparatus from malfunctioning on account of the information acquired through the communication.

As described above, the image forming apparatus of an example embodiment includes a detection section that detects a rotational angle of a rotating member by detecting a state of communication between a communication element and a communication section.

Also, as described above, the method of controlling rotation in accordance with an example embodiment is arranged such that the rotation of a rotating member is controlled in accordance with the state of the communication transmission between the communication element and the communication section.

On this account, using the communication element and the communication section, it is possible to perform the communication between the communication element and the communication section and the detection of the rotational angle of the rotating member. On this account, it is possible to decrease the number of components of the image forming apparatus, and lower the cost of the image forming apparatus.

Industrial applications of the present technology are as follows: the image forming apparatus of the present invention, in which the content of the content storage member is measured in reference to the state of communication between the communication element and the communication section, can be applied to various types of components in each of which an amount of the content changes in accordance with the operation of the image forming apparatus. Meanwhile, the image forming apparatus of example embodiment, in which the rotation of the rotating member is performed in accordance with the state of communication between the communication element and the communication section, can be applied to various types of components each rotating in the image forming apparatus.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus, comprising:

a communication section that communicates, in a non-contact manner, with a communication element attached to a content storage member storing predetermined content; and a content measurement section that measures the content of the content storage member, based on a change in a state of communication between the communication section and the communication element, the change occurring on account of the content existing between the communication section and the communication element.

2. The image forming apparatus as defined in claim 1, wherein, the content storage member rotates in the image forming apparatus, the communication element includes an antenna section, the communication section includes a communication device for communicating with the antenna section in the communication element, and the communication device is so positioned as to be capable of communicating with the antenna section over the content of the content storage member, at least once in 360° rotation of the content storage member.

3. The image forming apparatus as defined in claim 2, wherein, the change in the state of the communication, which is referred to by the content measurement section, is a change in a receiving intensity of a communication wave used for the communication.

4. The image forming apparatus as defined in claim 2, wherein, when the antenna section and the communication device face each other, a directivity in communication by the antenna section is matched with or in parallel to a directivity in communication by the communication device.

5. The image forming apparatus as defined in claim 2, wherein, the communication element includes a storage section storing maintenance information of the content storage member, the image forming apparatus further comprising a communication control section that allows for transmission of the maintenance information between the communication section and the communication element, only when the state of the communication between the communication section and the communication element is in a predetermined good state.

6. The image forming apparatus as defined in claim 5, wherein, the content is a developer, the content storage member is a developer supply container that supplies the developer to the image forming apparatus, the developer supply container has a developer supply opening through which the developer is supplied, the developer supply container stops rotation when the developer supply opening is at a predetermined position, and the antenna section and the communication device face each other when the developer supply opening is at the predetermined position.

7. The image forming apparatus as defined in claim 6, wherein, the antenna section and the communication device are so provided as to be capable of communicating one another over the developer accumulated in the developer supply opening of the developer supply container.

8. The image forming apparatus as defined in claim 2, further comprising:

apart from the communication element, another communication element capable of communicating with the communication section; and a communication control section, wherein while either the communication element or said another communication element communicates with the communication section, the communication control section prohibits a remaining communication element, which is different from that communication element communicating with the communication section, to communicate with the communication section.

9. The image forming apparatus as defined in claim 2, wherein, the content storage member is a developer supply container that stores a developer as the content, and supplies the developer to the image forming apparatus.

10. The image forming apparatus as defined in claim 9, wherein, the developer supply container has a developer supply opening through which the developer is supplied, and the developer supply container stops rotation at a position where the developer does not flow in through the developer supply opening, and at the position where the rotation stops, there is no intermediate between the antenna section and the communication device facing each other.

11. The image forming apparatus as defined in claim 10, wherein, the antenna section and the communication device are so positioned as to be capable of communicating with each other over the developer at the developer supply opening.

12. An image forming apparatus, comprising:

a communication section that communicates, in a non-contact manner, with a communication element provided on a rotating member rotatable inside a main body of the image forming apparatus, the communication element on the rotating member being away in a radial direction from a rotation axis of the rotating member;

a rotational angle detection section that detects a rotational angle of the rotating member, based on a change in a state of communication between the communication section and the communication element, the change occurring on account of a variation, in response to rotation of the rotating member, in relative positions of the communication element and the communication section; and a rotation control section that controls the rotation of the rotating member, in accordance with the rotational angle detected by the rotational angle detection section.

13. The image forming apparatus as defined in claim 12, wherein, the change in the state of the communication, which is referred to by the rotational angle detection section, is a change in a receiving intensity of a communication wave used for the communication.

14. The image forming apparatus as defined in claim 12, wherein, the rotational angle detection section detects the rotational angle, based on a degree of rotation from a referential position of the rotating member.

15. The image forming apparatus as defined in claim 12, wherein, the communication element includes an antenna section, the communication section includes a communication device for communicating with the antenna section, and when the antenna section and the communication device face each other, a directivity in communication by the antenna section is matched with or in parallel to a directivity in communication by the communication device.

16. The image forming apparatus as defined in claim 15, wherein, the content of the content storage member is a developer, the content storage member is a developer supply container that supplies the developer to the image forming apparatus, and the developer supply container has a developer supply opening through which the developer is supplied, the rotation control section causes the content storage member to stop rotation at a predetermined position where the developer does not flow in through the developer supply opening, and at the position where the rotation stops, there is no intermediate between the antenna section and the communication device facing each other.

17. The image forming apparatus as defined in claim 12, wherein, the communication element includes a storage section storing maintenance information of the rotating member, the image forming apparatus further comprising a communication control section that allows for transmission of the maintenance information between the communication section and the communication element, only when the state of the communication between the communication section and the communication element is a predetermined good state.

18. The image forming apparatus as defined in claim 12, further comprising:

apart from the communication element, another communication element capable of communicating with the communication section; and a communication control section, wherein while either the communication element or said another communication element communicates with the communication section, the communication control section prohibits a remaining communication element, which is different from that communication element communicating with the communication section, to communicate with the communication section.

19. The image forming apparatus as defined in claim 12, wherein, the rotating member is a content storage member storing predetermined content, the image forming apparatus further comprising a content measurement section that measures the content of the content storage member, based on a change in the state of the communication between the communication section and the communication element, the change occurring on account of the content existing between the communication section and the communication element.

20. An image forming apparatus, comprising:

a content storage member that stores predetermined content and has a communication element; and a communication section that communicates, in a non-contact manner, with the communication element, and a content measurement section that measures the content of the content storage member, based on a change in a state of communication between the communication section and the communication element.

21. The image forming apparatus as defined in claim 20, wherein, the content measurement section measures the content of the content storage member, based on a change in a receiving intensity of a communication wave used for the communication.

22. The image forming apparatus as defined in claim 20, wherein, the communication element includes (i) a storage section storing maintenance information of the content storage member and (ii) an antenna section.

23. The image forming apparatus as defined in claim 22, wherein, the communication section includes a communication device for communicating with the antenna section of the communication element, and the communication device so positioned as to be capable of communicating with the antenna section over the content in the content storage member.

24. The image forming apparatus as defined in claim 23, wherein, when the antenna section and the communication device face each other, a directivity in communication by the antenna section is matched with or in parallel to a directivity in communication by the communication device.

25. The image forming apparatus as defined in claim 23, further comprising an electromagnetic shield member that covers at least the communication element and the communication device.

26. The image forming apparatus as defined in claim 22, wherein, the content storage member rotates in the image forming apparatus, the communication section includes a communication device for communicating with the antenna section of the communication element, and the communication device is so positioned as to be capable of communicating with the antenna section over the content in the content storage member, at least once in 360° rotation of the content storage member.

27. The image forming apparatus as defined in claim 20, wherein, the content is a developer, and the content storage member is a developer supply container that supplies the developer to the image forming apparatus.

28. A content measurement method for an image forming apparatus including:

a content storage member that stores predetermined content and has a communication element; and a communication section that communicates, in a non-contact manner, with the communication element, according to the content measuring method, the content of the content storage member being measured based on a state of communication between the communication element and the communication section.

29. The content measurement method as defined in claim 28, wherein, the content storage member rotates in the image forming apparatus, and as the state of the communication, a receiving intensity of a communication wave used for the communication is measured while the content storage member rotates for 360°.

30. The content measurement method as defined in claim 29, wherein, a maximum value and a minimum value of the receiving intensity while the content storage member rotates for 360° are determined, and rotation of the content storage member is controlled based on a ratio between the maximum value and the minimum value.

31. The content measurement method as defined in claim 29, wherein, the communication element includes a storage section storing maintenance information of the content storage member, and communication control is carried out in such a way as to allow for transmission of the maintenance information between the communication section and the communication element, when the receiving intensity is not lower than a predetermined value.

32. The content measurement method as defined in claim 29, wherein, the communication element includes a storage section storing maintenance information of the content storage member, and communication control is performed so as to prevent the maintenance information from being fetched from the communication element, when the receiving intensity is not higher than a predetermined value.

33. The content measurement method as defined in claim 28, wherein, the image forming apparatus includes, apart from the communication element, another communication element capable of communicating with the communication section, and while either the communication element or said another communication element communicates with the communication section, a remaining communication element, which is different from that communication element communicating with the communication section, is prohibited for communicating with the communication section.

34. An image forming apparatus, comprising:

a rotating member that is rotatable in the image forming apparatus and has a communication element;

a communication section that communicates, in a non-contact manner, with the communication element; and a rotational angle detection section that detects a rotational angle of the rotating member, by detecting a state of communication between the communication element and the communication section.

35. The image forming apparatus as defined in claim 34, wherein, the rotational angle detection section detects the rotational angle of the rotating member, based on a change in a receiving intensity of a communication wave used for the communication.

36. The image forming apparatus as defined in claim 34, wherein, the rotational angle detection section measures a degree of rotation of the rotating member.

37. The image forming apparatus as defined in claim 34, wherein, the communication element includes (i) a storage section storing maintenance information of the rotating member, and (ii) an antenna section.

38. The image forming apparatus as defined in claim 37, wherein, the communication section includes a communication device for communicating with the antenna section of the communication element, and the communication device is so positioned as to face the antenna section, at least once in 360° rotation of the rotating member.

39. The image forming apparatus as defined in claim 38, wherein, when the antenna section and the communication device face each other, a directivity in communication by the antenna section is matched with or in parallel to a directivity in communication by the communication device.

40. The image forming apparatus as defined in claim 38, wherein, the rotating member stores predetermined content, and the antenna section and communication device are so positioned as to face each other over the content of the rotating member, at least once in 360° rotation of the rotating member.

41. The image forming apparatus as defined in claim 40, wherein, the developer supply container has a developer supply opening through which the developer is supplied, the developer supply container stops rotation when the developer supply opening is at a predetermined position, and the antenna section and the communication device face each other when the developer supply opening is at the predetermined position.

42. The image forming apparatus as defined in claim 34, wherein, the rotating member stores predetermined content.

43. The image forming apparatus as defined in claim 42, wherein, the rotating member is a developer supply container that supplies a developer to the image forming apparatus.

44. A method of controlling rotation, for an image forming apparatus including:

a rotating member that is rotatable in the image forming apparatus and has a communication element, and a communication section that communicates, in a non-contact manner, with the communication element, according to the method, rotation of the rotating member being controlled based on a state of communication between the communication element and the communication section.

45. The method as defined in claim 44, wherein, as the state of the communication, a receiving intensity of a communication wave used for the communication is measured, and the receiving intensity is measured while the rotating member rotates for 360°.

46. The method as defined in claim 45, wherein, a maximum value and a minimum value of the receiving intensity while the rotating member rotates for 360° are determined, and the rotation of the rotating member is controlled based on a ratio between the maximum value and the minimum value.

47. The method as defined in claim 45, wherein, the communication element includes a storage section storing maintenance information of the rotating member, and communication control is carried out in such a way as to allow for transmission of the maintenance information between the communication section and the communication element, when the receiving intensity is not lower than a predetermined value.

48. The method as defined in claim 45, wherein, the communication element includes a storage section storing maintenance information of the rotating member, and communication control is performed so as to prevent the maintenance information from being fetched from the communication element, when the receiving intensity is not higher than a predetermined value.

* * * * *